US006439184B1

(12) United States Patent
Takenaka et al.

(10) Patent No.: US 6,439,184 B1
(45) Date of Patent: Aug. 27, 2002

(54) VALVE TIMING ADJUSTING SYSTEM OF INTERNAL COMBUSTION ENGINE

(75) Inventors: Akihiko Takenaka, Anjo; Masashi Hayashi; Akira Hori, both of Kariya, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/046,816

(22) Filed: Jan. 17, 2002

(30) Foreign Application Priority Data

Jan. 31, 2001 (JP) ..... 2001-023256
Mar. 29, 2001 (JP) ..... 2001-095932

(51) Int. Cl.[7] ..... F01L 1/34
(52) U.S. Cl. ..... 123/90.17; 123/90.65
(58) Field of Search ..... 123/90.15, 90.17, 123/90.31, 90.65

(56) References Cited

U.S. PATENT DOCUMENTS 5,738,056 A 4/1998 Mikame et al. ..... 123/90.17
6,035,819 A 3/2000 Nakayoshi et al. ..... 123/90.17
6,062,182 A 5/2000 Ogawa ..... 123/90.17
6,276,321 B1 * 8/2001 Lichti et al. ..... 123/90.17
6,374,786 B1 * 4/2002 Ogawa ..... 123/90.17

FOREIGN PATENT DOCUMENTS

JP 11-294121 10/1999

* cited by examiner

*Primary Examiner*—Weilun Lo
(74) *Attorney, Agent, or Firm*—Nixon & Vanderhye P.C.

(57) ABSTRACT

An effective range of urging force of an assist spring is between a maximum retarded phase and a predetermined phase of a camshaft, a vane rotor and vanes. The predetermined phase is equal to an intermediate locking phase of the camshaft, the rotor and the vanes+10 degree CA. Even when oil pressure supplied to each advancing chamber is reduced at the time of engine stop, the camshaft, the rotor and the vanes can be advanced to or beyond the intermediate phase by the spring. Furthermore, at the time of engine start, the rotor and the vanes are positioned near the intermediate phase, so that reaction force of the spring is very small, allowing easy movement of the rotor with drive torque of the camshaft toward a retard side. Thus, the rotor can be locked at the intermediate phase by a lock pin.

16 Claims, 10 Drawing Sheets

VALVE TIMING ADJUSTING SYSTEM OF INTERNAL COMBUSTION ENGINE

CROSS REFERENCE TO RELATED APPLICATION

This application is based on and incorporates herein by reference Japanese Patent Application No. 2001-23256 filed on Jan. 31, 2001 and Japanese Patent Application No. 2001-95932 filed on Mar. 29, 2001.

BACKGROUND OF THE INVENTION

1. Field of the Invention:

The present invention relates to a valve timing adjusting system of an internal combustion engine capable of staring at an intermediate phase of a camshaft and of a vane rotor, which is generally located in the middle of a variable phase range of the camshaft and of the vane rotor. The valve timing adjusting system can continuously vary opening and closing time phases of each intake valve or each exhaust valve of the internal combustion engine.

2. Description of Related Art:

In one previously proposed variable intake valve timing mechanism, a camshaft is rotated, for example, through a timing pulley and a chain sprocket, which are synchronously rotated with a crankshaft of an internal combustion engine. Opening time and closing time (hereinafter, referred to as "valve timing") of each intake valve of the internal combustion engine is varied with use of a phase difference produced by relative rotation between the timing pulley or the chain sprocket and the camshaft to increase engine power and to reduce fuel consumption of the internal combustion engine.

By way of example, the fuel consumption can be reduced by reducing pumping losses of the engine. This can be achieved by closing each intake valve after a corresponding piston reaches its bottom dead center. In the case where the intake valve is closed after the piston reaches its bottom dead center, the fuel consumption is advantageously reduced after warming up of the engine, but an actual compression ratio during cold engine operation is disadvantageously reduced, and thus air temperature at a top dead center of the piston cannot be raised to a sufficient level, causing engine start failure. In such a case, the time required to start the engine is increased, or the engine cannot be started.

In the above state, the optimum valve timing of the intake valve during the cold engine operation is on the advanced side relative to the optimum valve timing of the intake valve during the warm engine operation after the warming up. Thus, in the variable intake valve timing mechanism, which changes the valve timing of each intake valve, the optimum valve timing (the optimum opening time and the optimum closing time of each intake valve) suitable for the cold engine start differs from the optimum valve timing (the optimum opening time and the optimum closing time of each intake valve) suitable for reducing the fuel consumption after the warming up of the engine.

To address this disadvantage, there is proposed a variable intake valve timing mechanism (Japanese Unexamined Patent Publication No. 9-324613 corresponding to U.S. Pat. No. 5,738,056), which has a lock pin for locking an internal rotor at an intermediate phase located generally in the middle of a variable phase range of the intake camshaft or of the intake valve timing. With this arrangement, the engine can be started at the intermediate phase which is suitable for the cold engine start.

However, in the above arrangement, lock of the internal rotor generally at the intermediate phase located in the middle of the variable phase range with use of the lock pin at the time of engine stop largely depends on a reduction of oil pressure induced by a reduction in an engine speed. Thus, the reduction of the oil pressure supplied in the advancing chamber varies depending on a change in the temperature of the engine oil. As a result, when the oil pressure supplied to each advancing oil chamber is relatively low at the time of engine stop, the internal rotor and the vanes, which rotate together with the intake camshaft, can not be easily advanced generally to the intermediate phase located in the middle of the variable phase range. Therefore, it is difficult to lock the intake camshaft and the valve timing of the intake valve generally at the intermediate phase located in the middle of the variable phase range.

Japanese Unexamined Patent Publication No. 11-223112 corresponding to U.S. Pat. No. 6,062,182 discloses another variable intake valve timing mechanism, which locks a camshaft and an internal rotor generally at an intermediate phase of a variable phase range of the camshaft and of the internal rotor at the time of engine start with use of a lock pin. This is achieved as follows. At the time of engine stop, the internal rotor and vanes are urged by a spring toward an advance side within an effective range of urging force of the spring, which is between a maximum retarded phase and a maximum advanced phase of the camshaft and of the internal rotor. Then, at the time of engine start, the phase of the internal rotor and of the vanes are fluctuated because of fluctuating torque of the camshaft. This fluctuation of the phase of the internal rotor and of the vanes causes the camshaft and the internal rotor to be locked by the lock pin generally at the intermediate phase of the variable phase range of the camshaft and of the internal rotor.

However, with this arrangement, when the internal rotor and the vanes are stopped at the maximum advance phase at the time of engine stop, the urging force of the spring acts against the retardation of the internal rotor and the vanes caused by the drive torque of the camshaft, so that the internal rotor and the vanes cannot be retarded immediately at the time of engine start, preventing locking of the internal rotor and the vanes by the lock pin. As a result, the engine cannot be reliably started at generally the intermediate phase located in the middle of the variable phase range.

Furthermore, in a case where the valve timing adjusting system is provided to an exhaust camshaft, when both the exhaust camshaft and intake camshaft are in a retarded phase at the time of engine start, an overlap period, during which both the intake valve and the exhaust valve of one cylinder are opened, is unnecessarily increased, causing engine start failure.

Japanese Unexamined Patent Publication No. 11-294121 discloses one technique for solving the above disadvantage. In this technique, one end of a torsion coil spring is engaged with a timing pulley, which is rotated together with a shoe housing, and the other end of the torsion coil spring is engaged with a vane rotor. The vane rotor is always urged in an advance direction relative to the shoe housing by the torsion coil spring.

In the valve timing adjusting system disclosed in the above Japanese Unexamined Patent Publication No. 11-294121, the one end and the other end of the torsion coil spring both axially extend. The other end of the torsion coil spring is inserted and is secured in an axially elongated hole formed in the vane rotor.

When a portion of the torsion coil spring is bent to provide the corresponding axially extending end portion, a curvature R of the bent portion should be equal to or greater than a predetermined value in order to achieve a sufficient strength at the bent portion. The bent portions and the axially extending end portions (engaging portions) of the torsion coil spring increase an axial length of the torsion coil spring, resulting in an increase in an axial size of the valve timing adjusting system.

Furthermore, the other end of the torsion coil spring is inserted in the axially elongated hole formed in the vane rotor, so that the torsion coil spring directly slidably contacts the vane rotor. Thus, the rotor needs to be made from a relatively rigid wear resistant material. However, when the vane rotor is made of the relatively rigid material, a manufacturing cost of the vane rotor is disadvantageously increased, and thus a manufacturing cost of the valve timing adjusting system is disadvantageously increased.

SUMMARY OF THE INVENTION

The present invention addresses the above disadvantages. Thus, it is a first objective of the present invention to provide a valve timing adjusting system of an internal combustion engine capable of more reliably advancing a driven-side rotator at least to an intermediate phase of the driven-side rotator located in the middle of a variable phase range of the driven-side rotator with use of hydraulic fluid pressure supplied to each advancing chamber and also with use of urging force of an advance side urging means at the time of engine stop. It is a second objective of the present invention to provide a valve timing adjusting system of the internal combustion engine, which allows the engine to be more reliably started at generally the intermediate phase located in the middle of the variable phase range of the driven-side rotator. It is a third objective of the present invention to reduce an axial size of a valve timing adjusting system by reducing an axial length of a torsion coil spring. It is a fourth objective of the present invention to reduce a cost of a valve timing adjusting system by reducing a manufacturing cost of a vane rotor by forming the vane rotor with a relatively soft material. It is a fifth objective of the present invention to reduce the cost of a valve timing adjusting system by reducing a manufacturing cost required for engaging a torsion coil spring to a vane rotor through use of a positioning hole, which is formed in the vane rotor and to which the torsion coil spring is engaged.

To achieve the objectives of the present invention, there is provided a valve timing adjusting system of an internal combustion engine for adjusting opening time and closing time of at least one of intake and exhaust valves. The valve timing adjusting system is provided in a driving force transmission system that allows the internal combustion engine to be started at generally an intermediate phase of a driven shaft located in the middle of a variable phase range of the driven shaft, which is driven by a driving shaft of the internal combustion engine to open and close the at least one of the intake and exhaust valves. The valve timing adjusting system includes a driving-side rotator, driven-side rotator, an advancing chamber, a retarding chamber, a hydraulic pressure supply/drain means, a phase restraining means and an advance side urging means. The driving-side rotator is rotated synchronously with the driving shaft of the internal combustion engine. The driven-side rotator is rotated together with the driven shaft and is capable of relative rotation relative to the driving-side rotator. The advancing chamber applies hydraulic fluid pressure to the driven-side rotator to rotate the driven-side rotator in such a manner that a phase of the driven-side rotator is advanced relative to the driving-side rotator. The retarding chamber applies hydraulic fluid pressure to the driven-side rotator to rotate the driven-side rotator in such a manner that the phase of the driven-side rotator is retarded relative to the driving-side rotator. The hydraulic pressure supply/drain means supplies the hydraulic pressure to the advancing chamber and drains the hydraulic pressure from the retarding chamber when the internal combustion engine is turned off. The phase restraining means restrains the relative rotation between the driving-side rotator and the driven-side rotator at generally an intermediate phase of the driven-side rotator after the engine is turned off or when the engine is started. The intermediate phase of the driven-side rotator is located in the middle of a variable phase range of the driven-side rotator. The advance side urging means applies urging force to the driven-side rotator to advance the;driven-side rotator on an advance side. An effective range of the urging force of the advance side urging means is between a maximum retarded phase of the driven-side rotator and a predetermined phase of the driven-side rotator. The predetermined phase of the driven-side rotator is located near an intermediate phase of the driven-side rotator on an advance side of the intermediate phase of the driven-side rotator.

The advance side urging means can be a spring. One end of the spring can be retained by the driving-side rotator, and the other end of the spring can be retained by the driven-side rotator and extends in a direction perpendicular to an axial direction of the driven-side rotator. The driven-side rotator can include an engaging portion for engaging with the other end of the spring. The engaging portion can extend in the direction perpendicular to the axial direction of the driven-side rotator.

The engaging portion of the driven-side rotator can receive a wear resistant member made of a wear resistant material. The wear resistant member is arranged between the other end of the spring and the engaging portion of the driven-side rotator.

The driven-side rotator can include a positioning hole, which axially penetrates through the driven-side rotator for positioning the driven-side rotator to the driven shaft. The other end of the spring retained by the driven-side rotator can be alternatively extended in the axial direction of the driven-side rotator and can be engaged with the positioning hole.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Figure 1:
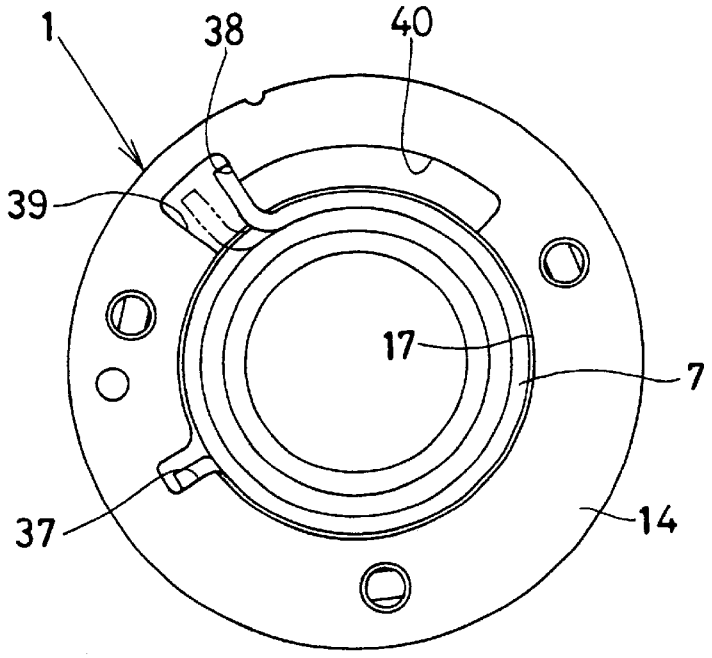
FIG. 1 is a front view showing a spring receiving groove of a chain sprocket of a timing rotor of a continuously variable valve timing mechanism according to a first embodiment of the present invention.

Various embodiments of the present invention will be described with reference to the accompanying drawings. Similar numerals refer to similar parts throughout the drawings.

(First Embodiment)

A first embodiment of the present invention will be first described with reference to FIGS. 1 to 6.

According to the present embodiment, there is provided a continuously variable valve timing adjusting system arranged in a driving force transmission system that transmits a driving force from a crankshaft of an internal combustion engine to intake and exhaust valves. The continuously variable valve timing adjusting system can continuously vary a valve timing of each intake valve (not shown) arranged in a cylinder head E of the internal combustion engine, more particularly, a four cycle reciprocating engine, such as a DOHC (Double Overhead Camshaft) engine, (hereinafter, simply referred to as "engine").

The continuously variable valve timing adjusting system includes a continuously variable intake valve timing mechanism and an electronic engine control system (an oil pressure control means, hereinafter referred to as "ECU"). The continuously variable intake valve timing mechanism includes a timing rotor 1, an intake camshaft (hereinafter, simply referred to as "camshaft") 2 and a vane rotor 3. The timing rotor 1 is rotatably driven by a driving shaft (not shown, and hereinafter referred to as "crankshaft") of the engine. The intake camshaft 2 acts as a driven shaft that is rotatable relative to the timing rotor 1. The vane rotor 3 is secured to one axial end of the camshaft 2 and is rotatably received in the timing rotor 1. The ECU electronically controls an electromagnetic oil passage switch valve 4 and an electromagnetic oil pressure control valve 5, which cooperate together to selectively supply and drain an oil pressure relative to advancing chambers 11 and retarding chambers 12 of the continuously variable intake valve timing mechanism.

The timing rotor 1 corresponds to a driving-side rotator of the present invention and includes a generally annular plate-shaped chain sprocket 14, a generally cylindrically shaped shoe housing 15, three smaller diameter bolts 16 and the like. The chain sprocket 14 is rotated by the crankshaft of the engine through a timing chain 13. The shoe housing 15 is attached to a front end wall surface of the chain sprocket 14. The smaller diameter bolts 16 threadably secure the chain sprocket 14 and the shoe housing 15 together.

The chain sprocket 14 includes a plurality of teeth 18 arranged along an outer peripheral side of the chain sprocket 14 to mesh with a plurality of corresponding teeth (not shown) arranged along an inner peripheral side of the timing chain 13. Three female-threaded holes are formed in an annular plate portion of the chain sprocket 14 (the annular plate portion constitutes a rear cover portion for covering a rear end of the shoe housing 15) to threadably engage with the three smaller diameter bolts 16, respectively. Furthermore, an annular spring receiving groove 17 is formed in the front end wall surface of the chain sprocket 14 to receive an advance assist spring 7, which will be described in greater details.

The shoe housing 15 includes a cylindrical shoe housing main body 115, which rotatably receives the vane rotor 3, and an annular plate shaped front cover portion 19, which cover an axial front end of the shoe housing main body 115 of the shoe housing 15. The shoe housing main body 115 of the shoe housing 15 includes a plurality (three in this instance) of trapezoidal shaped shoes (partitions) 9, which are circumferentially arranged and extend radially inwardly. An opposing surface of each shoe 9 has an arcuate cross section. A fan shaped space is circumferentially defined between each two adjacent shoes 9. Three bolt receiving through holes for respectively receiving the three smaller diameter bolts 16 are provided in the shoes 9.

The camshaft 2 is received in the cylinder head E of the engine and is connected to the crankshaft of the engine in such a manner that the camshaft 2 makes one rotation when the crankshaft makes two rotations. The camshaft 2 includes a plurality of cam lobes (the number of the cam lobes corresponds to the number of the cylinders of the engine). Each cam lobe determines opening time and closing time (valve timing) of the corresponding intake valve of the engine. One end of the camshaft 2 is secured to the vane rotor 3 together with a journal bearing 25 by a larger diameter bolt 24. A female threaded hole for threadably engaging with the larger diameter bolt 24 is formed at the center of the one end of the camshaft 2. Generally, the intake valves and exhaust valves are arranged to open when they are pushed by the corresponding cam lobes of the corresponding camshaft. Furthermore, the intake valves and exhaust valves are closed by spring force of corresponding valve springs when the valves are released from the corresponding cam lobes.

The continuously variable intake valve timing mechanism of the present embodiment includes the timing rotor 1, the vane rotor 3, the electromagnetic oil passage switch valve 4, the electromagnetic oil pressure control valve 5, a lock pin 6 and the advance assist spring 7. The vane rotor 3 is rotatably received in the timing rotor 1. The electromagnetic oil passage switch valve 4 and the: electromagnetic oil pressure control valve 5 cooperate together to selectively supply and drain oil pressure relative to each advancing chamber 11 and each retarding chamber 12. The lock pin 6 locks the vane rotor 3 at a desired intermediate locking phase after engine stop or at the time of engine start. The advance assist spring 7 assists the vane rotor 3 to advance beyond the desired intermediate locking phase at the time of engine stop. The desired intermediate locking phase is located in the middle of a variable phase range located between the maximum retarded phase and the maximum advanced phase of the camshaft 2, the vane rotor 3 and the vanes 10 described below.

The vane rotor 3 corresponds to a driven-side rotator of the present invention and has the vanes 10 (the number of the vanes 10 in this instance is three) and the journal bearing 25 rotatably supported along the inner peripheral surface of the front cover portion 19 of the shoe housing 15. A female threaded hole for threadably engaging with the larger diameter bolt 24 is formed at the center of a base portion of the vane rotor 3. An annular receiving through hole 26 for receiving the larger diameter bolt 24 therethrough is formed in the center of the journal bearing 25.

A small clearance is provided between the outer peripheral walls of the vanes 10 of the vane rotor 3 and an inner peripheral wall of the shoe housing main body 115 of the shoe housing 15. Thus, the camshaft 2, the vane rotor 3 and the vanes 10 can rotates relative to the chain sprocket 14 and the shoe housing 15 within the variable phase range (e.g., 0 to 90 degree crank angle (CA)) Furthermore, the vane rotor 3 and the vanes 10 cooperate with the shoe housing 15 to form a vane type hydraulic actuator, which can continuously vary the valve timing of each intake valve of the engine with use of the oil pressure. A plurality of seal members 27 are placed between the outer peripheral walls of the vanes 10 of the vane rotor 3 and the shoe housing main body 115 of the shoe housing 15, respectively. A plurality of seal members 28 are placed between an outer peripheral wall of the base portion of the vane rotor 3 and inner peripheral walls of the shoes 9 of the shoe housing 15, respectively.

The vanes 10 of the vane rotor 3 are arranged such that each two adjacent vanes 10 circumferentially oppose each other. Furthermore, each vane 10 of the vane rotor 3 is the fan shaped vane and is arranged to protrude into the fan shaped space defined between the corresponding two adjacent shoes 9. Two circumferentially opposed lateral surfaces of each two adjacent shoes 9 and lateral surfaces of the vane 10 arranged in the fan shaped space defined between the two adjacent shoes 9 form the advancing oil pressure chamber (hereinafter referred to as "advancing chamber") 11 and the retarding oil pressure chamber (hereinafter referred to as "retarding chamber") 12. That is, each vane 10 divides the fan shaped space defined between the corresponding two adjacent shoes 9 into the two oil pressure chambers, i.e., the advancing chamber 11 and the retarding chamber 12, which are fluidly sealingly separated from one another.

An annular seal plate 34 for fluidly sealingly separating the advancing chambers 11 and the retarding chambers 12 from the annular spring receiving groove 17 is held between the front end wall surface of the chain sprocket 14 and a rear end surface of the vane rotor 3 as well as a rear end surface of the shoe housing main body 115 of the shoe housing 15. The seal plate 34 has an arcuate window 36 that penetrates through the seal plate 34. The window 36 receives a cylindrical pin (corresponding as "engaging portion" of the present invention) 35 that is press fitted and is secured into a hole formed in one of the vanes 10.

The hydraulic system circuit, which selectively supplies and drains the oil pressure relative to each advancing chamber 11 and each retarding chamber 12, includes a first oil supply passage (advancing chamber side oil passage) 21, a second oil supply passage (retarding chamber side oil passage) 22 and a third oil supply passage (communication passage) 23. The first oil supply passage 21 supplies and drains the oil pressure relative to each advancing chamber 11. The second oil supply passage 22 supplies and drains the oil pressure relative to each retarding chamber 12. The third oil supply passage 23 is branched off from the first oil supply passage 21. The third oil supply passage 23 can conduct the oil pressure of the oil pump 20 to the oil passage formed in the outer peripheral portion of the spool valve 4*a* of the electromagnetic oil passage switch valve 4 through the first oil supply passage 21. The first to third oil supply passages 21–23 are formed in the cylinder head E of the engine and also act as drain passages for draining the oil from each advancing chamber 11 and each retarding chamber 12.

The first and second oil supply passages 21, 22 are communicated with the oil pump 20 (oil pressure source) side oil supply passage 29 and first and second oil drain passages (first and second drain oil passages) 31, 32 through oil passages formed in an outer peripheral portion of a spool 46 of the electromagnetic oil pressure control valve (oil control valve: OCV) 5. The first oil drain passage 31 is the advancing chamber side drain oil passage, and the second oil drain passage 32 is the retarding chamber side drain oil passage. First and second oil supply passages 41, 42 are formed in the camshaft 2 and the vane rotor 3. The first oil supply passage 41 communicates each advancing chamber 11 to the first oil supply passage 21, and the second oil passage 42 communicates each retarding chamber 12 to the second oil passage 22.

The pump 20 is arranged in the oil supply passage 29 to pump the engine oil, which acts as hydraulic fluid and is temporally received in an oil pan 30, toward various portions of the engine. Outlet ends of the first and second oil drain passages 31, 32 are connected to the oil pan 30. The oil pump 20 is rotated synchronously with the crankshaft of the engine to pump the oil toward the various portions of the engine in an amount that is proportional to an engine speed of the engine.

Figure 2:
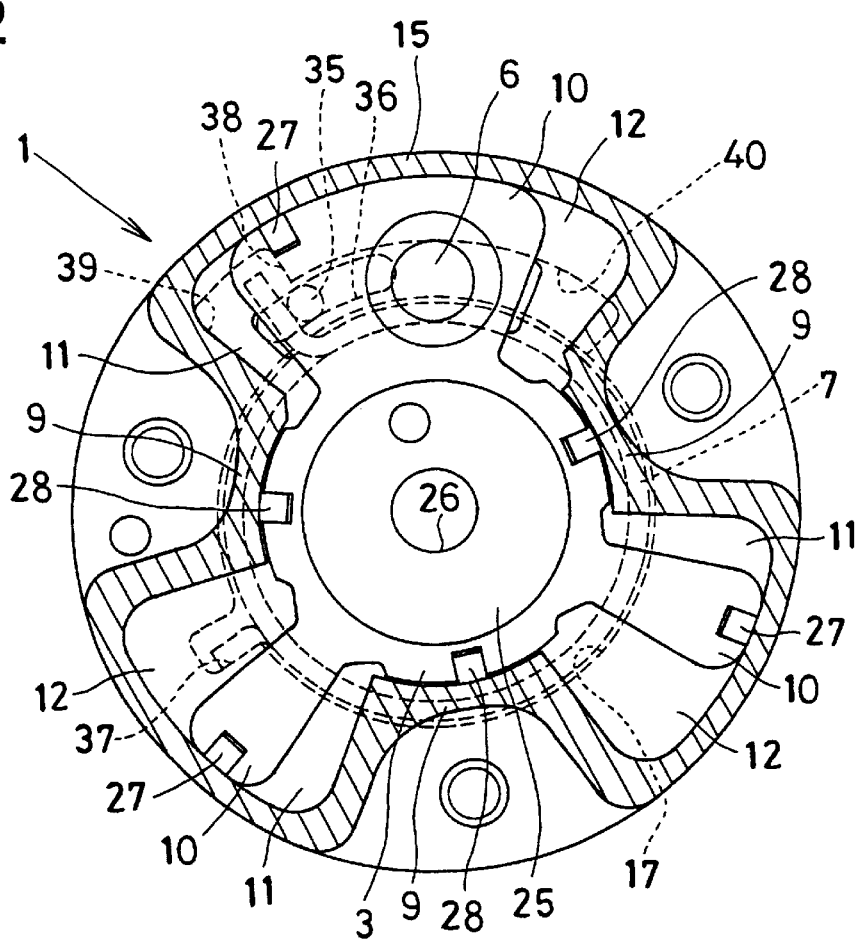
FIG. 2 is a cross-sectional view showing a main feature of a continuously variable intake valve timing mechanism according to the first embodiment.
Figure 3:
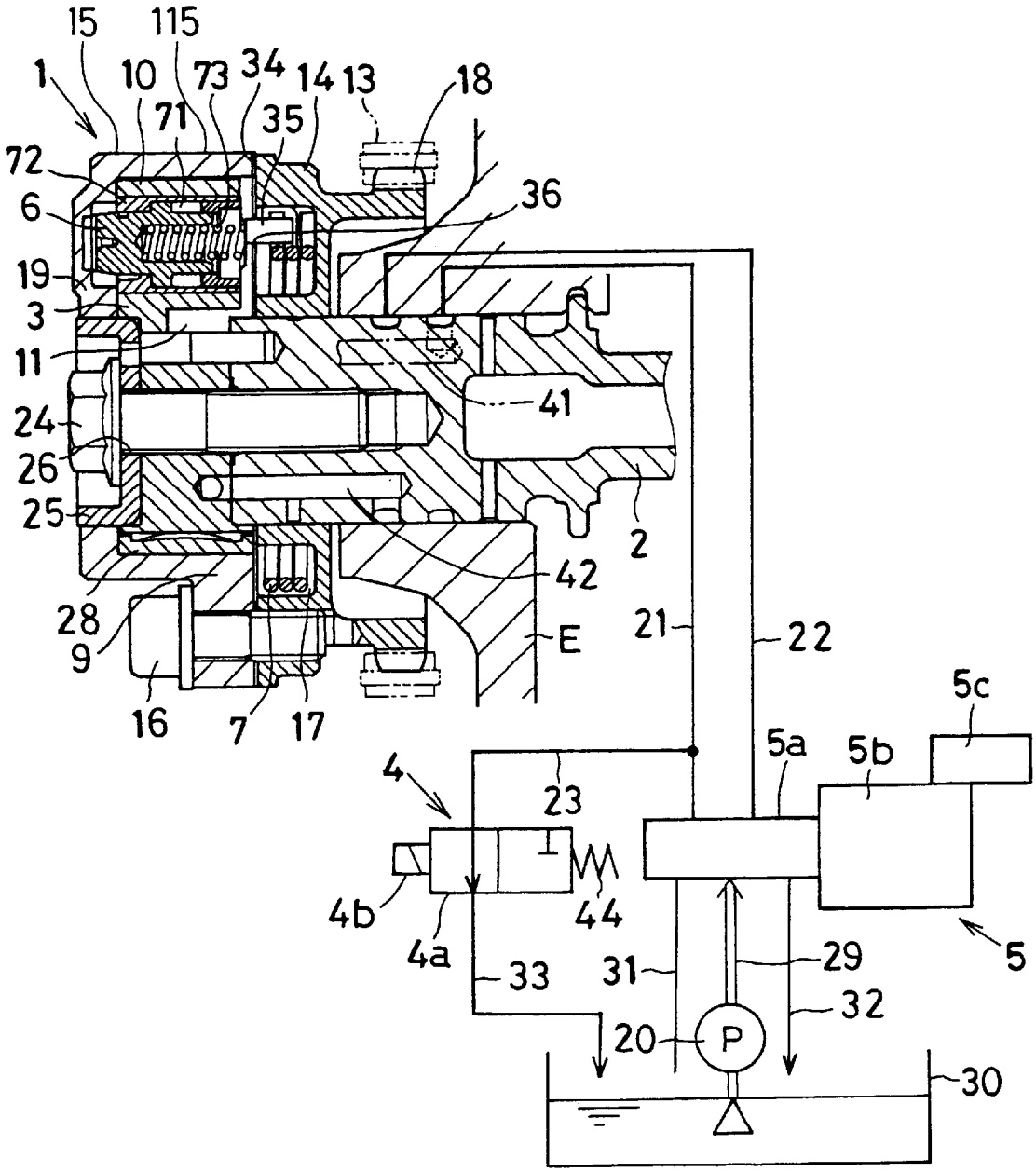
FIG. 3 is a schematic view showing the main feature of the continuously variable intake valve timing mechanism according to the first embodiment.
Figure 5:
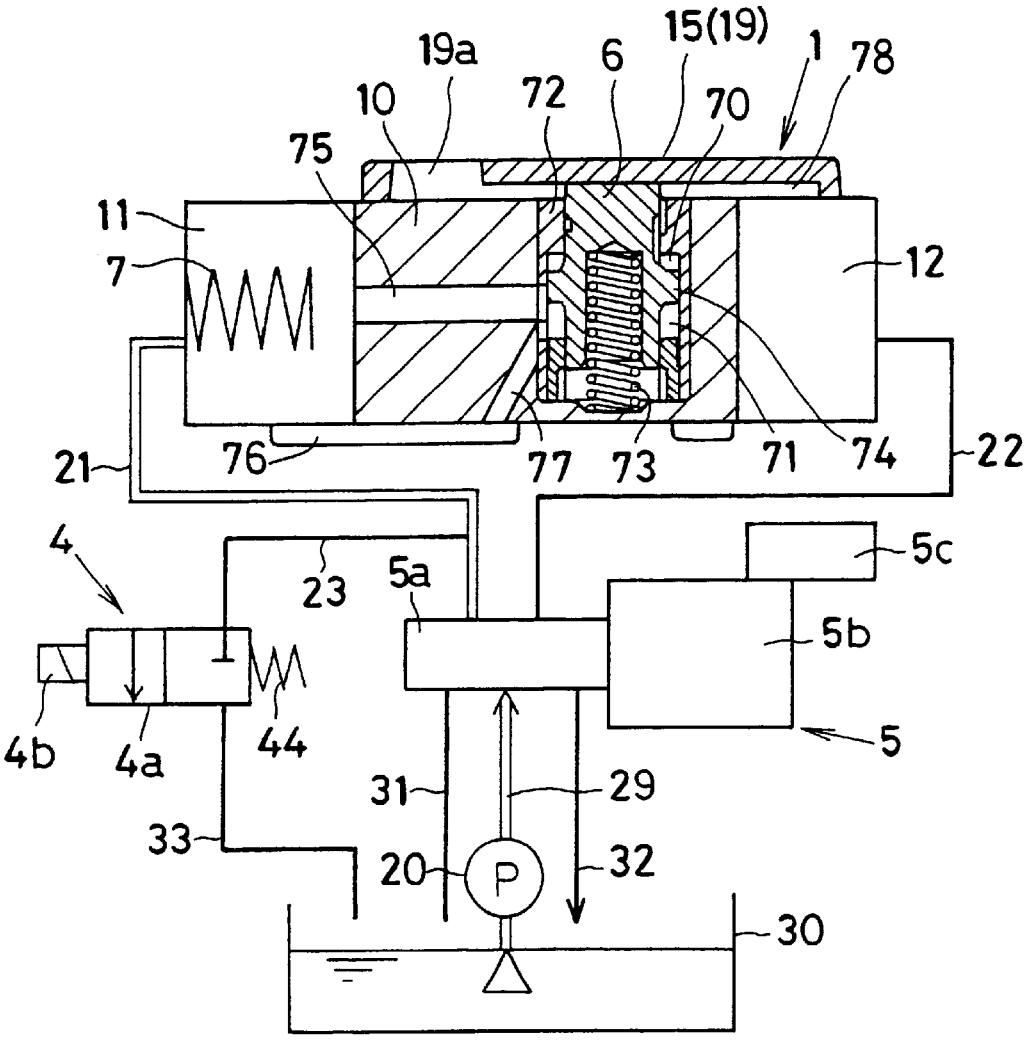
FIG. 5 is a state diagram showing an advance control mode of the continuously variable intake valve timing mechanism according to the first embodiment.
Figure 6:
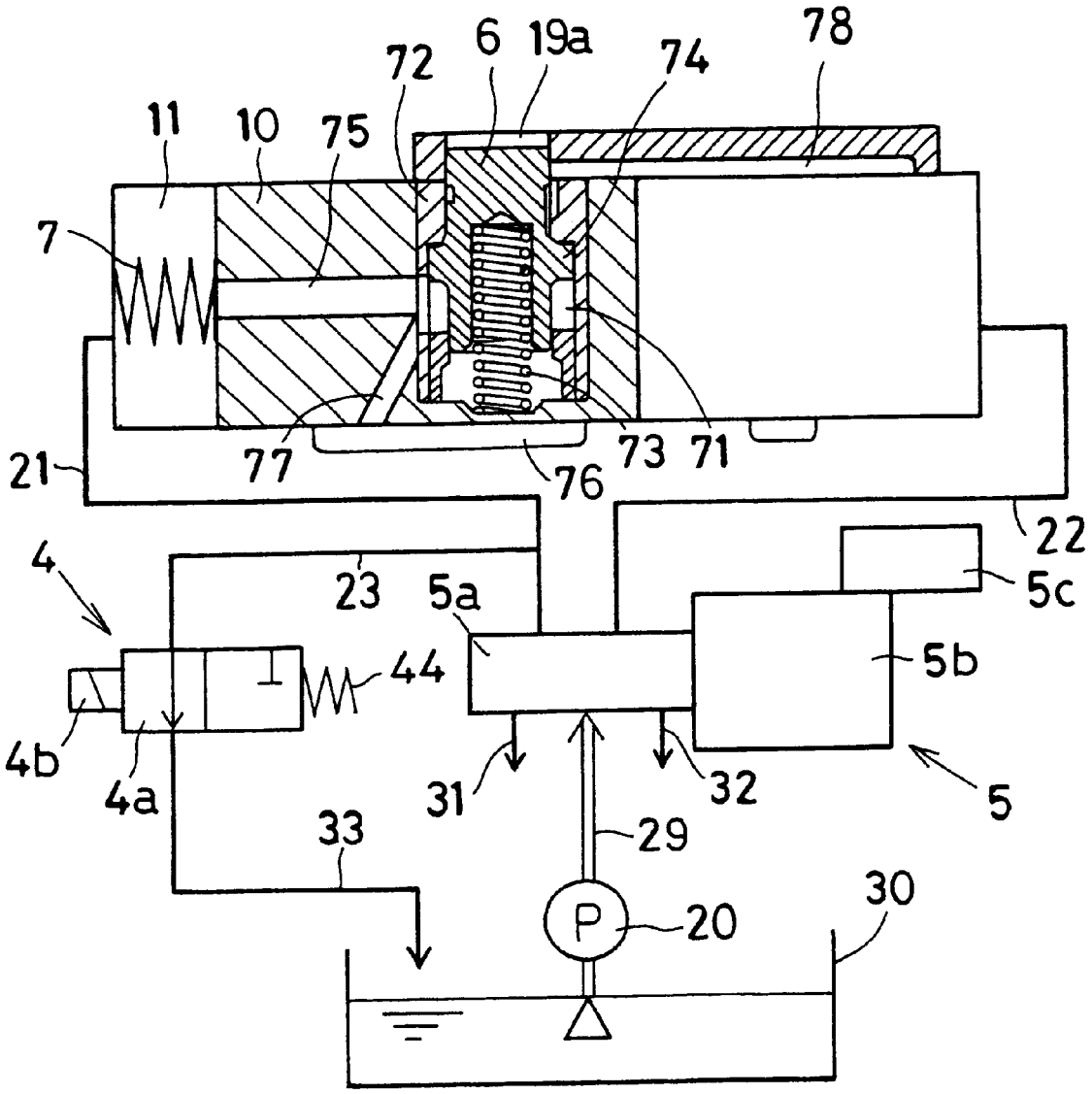
FIG. 6 is a state diagram showing a drain mode of the continuously variable intake valve timing mechanism according to the first embodiment.

With reference to FIGS. 2, 5 and 6, the electromagnetic oil passage switch valve 4 corresponds to a hydraulic pressure supply/drain means of the present invention. The electromagnetic oil passage switch valve 4 is the oil passage switch means, which includes the spool valve 4*a* arranged in the hydraulic system circuit, a spring 44 for urging the spool valve 4*a* toward its initial position, and an electromagnetic actuator 4*b* for driving the spool valve 4*a*. The spool valve 4*a* is arranged between a third oil drain passage (third drain oil passage) 33 and the third oil supply passage 23, which cooperate together to communicate between each advancing chamber 11 and the oil pump 20 as well as the oil pan 30 through the first oil supply passage 21.

The spool valve 4*a* includes the oil passage for communicating between the third oil supply passage 23 and the third oil drain passage 33 and also includes an oil passage for discommunicating between the third oil supply passage 23 and the third oil drain passage 33. Thus, by axially shifting the spool valve 4*a* by controlling the electromagnetic actuator 4*b* through the ECU, the electromagnetic oil passage switch valve 4 can be switched between a drain mode, in which the third oil supply passage 23 is communicated with the third oil drain passage 33, and an advance control mode, in which the third oil supply passage 23 is discommunicated from the third oil drain passage 33.

The electromagnetic oil pressure control valve 5 corresponds to the hydraulic pressure supply/drain means of the present invention. As shown in FIGS. 3 to 6, the electromagnetic oil pressure control valve 5 is the oil pressure supply/drain means, which includes the control valve 5*a* arranged in the hydraulic system circuit and an electromagnetic actuator 5*b,* for driving the control valve 5*a*. The electromagnetic oil pressure control valve 5 can be switched to communicate the first oil supply passage 21 to the first oil drain passage 31 or to the oil supply passage 29 and also to communicate the second oil supply passage 22 to the oil supply passage 29 or to the second oil drain passage 32.

The control valve 5*a* includes a cylindrical sleeve 45, a spool (spool valve) 46 and a spring 47. The sleeve 45 is arranged between the first and second oil supply passages 21, 22 and the oil supply passage 29 and the first and second oil drain passages 31, 32. The spool 46 is slidably received in the sleeve 45. The spring 47 urges the spool. 46 toward its initial position (electromagnetic actuator 5*b* side).

The sleeve 45 includes an oil supply port 49 that is connected to the oil pump 20 side oil supply passage 29. The sleeve 45 also includes first and second drain ports 51, 52 and first and second oil supply/drain ports 61, 62. The first drain port 51 drains the oil contained in each advancing chamber 11, and the second drain port 52 drains the oil contained in each retarding chamber 12. The first oil supply/drain port 61 is connected to the first oil supply passage 21, and the second oil supply/drain port 62 is connected to the second oil supply passage 22. Four lands, i.e., first to fourth lands are formed in the outer peripheral portion of the spool 46 to define three oil passages, which are axially arranged between a left end and a right end of the spool 46 in FIG. 4.

The electromagnetic actuator 5*b* includes a cylindrical yoke 54, a coil bobbin 55, a solenoid coil 56, a stator core (stationary iron core) 57 and a movable core (movable iron core) 58 and a solenoid shaft 59. The yoke 54 is secured to the right end of the sleeve 45 of the control valve 5*a* in FIG. 4. The coil bobbin 55 is arranged inward of the yoke 54. The solenoid coil 56 is wound around the coil bobbin 55. The stator core 57 and the movable core 58 are arranged inward of the coil bobbin 55. The solenoid shaft 59 moves together with the movable core 58.

Figure 4:
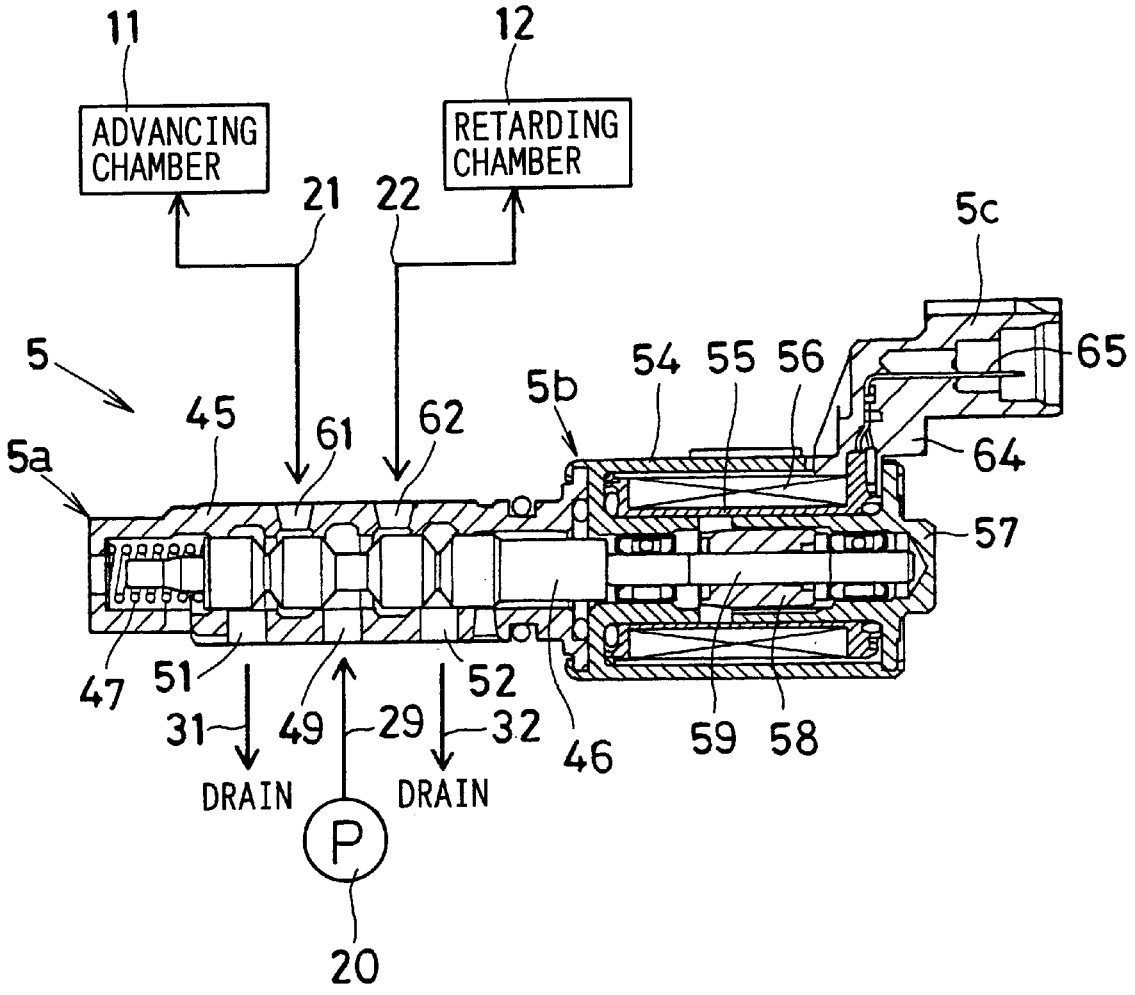
FIG. 4 is a longitudinal cross-sectional view of an electromagnetic oil pressure control valve according to the first embodiment.

The left end portion of the solenoid shaft 59 of the electromagnetic actuator 5*b* in FIG. 4 is engaged with the right end surface of the spool 46 of the control valve 5*a*. With this arrangement, the spool 46 of the control valve 5*a* axially reciprocates together with the movable core 58 and the solenoid shaft 59. The coil bobbin 55 is the molded primary resin product, which is integrally molded into a generally cylindrical shape. Furthermore, a molded resin product (molded secondary resin product) 64 is molded to the outer peripheral portion of the solenoid coil 56. A connector portion 5*c* is integrally molded to an external portion of the molded resin product 64, which is located outward of the yoke 54. Terminals (connection terminals) 65 for electrically connecting the solenoid coil 56 to a vehicle battery are insert molded to the connector portion 5*c*. When drive current is supplied to the solenoid coil 56 from the ECU during operation of the engine, the solenoid coil 56 generates a magnetomotive force to attract the movable core 58.

The ECU determines the current operating state of the engine based on signals of a crank angle sensor for measuring an engine speed, signals of an engine load sensor, and signals of an air flow meter for measuring an amount of intake air. Furthermore, the ECU determines a relative rotational position of the timing rotor 1 with respect to the camshaft 2, the vane rotor 3 and the vanes 10 and also measures the intermediate locking phase of the camshaft 2, the vane rotor 3 and the vanes 10 based on signals of the crank angle sensor and signals of a cam angle sensor. The ECU controls the control mode of the electromagnetic oil passage switch valve 4 and the electromagnetic oil pressure control valve 5 such that the opening time and closing time of each intake vale of the engine is optimized based on the engine speed and/or the engine load.

Thus, the control mode of the electromagnetic oil pressure valve 5 is shifted to:the advance control mode or the drain mode when the drive current is supplied to the solenoid coil 56 of the electromagnetic actuator 5*b* to axially move the spool 46 of the control valve 5*a* in such a manner that the center oil passage in the outer peripheral portion of the spool 46 communicates between the oil supply passage 29 and the first oil supply passage 21, and the right oil passage in the outer peripheral portion of the spool 46 in FIG. 4 communicates between the second oil drain passage 32 and the second oil supply passage 22.

The control mode of the electromagnetic oil pressure control valve 5 is shifted to a retard control mode when the drive current is supplied to the solenoid coil 56 to axially move the spool 46 in such a manner that the center oil passage in the outer peripheral portion of the spool 46 communicates between the oil supply passage 29 and the second oil supply passage 22, and the left oil passage in the outer peripheral portion of the spool 46 in FIG. 4 communicates between the first oil drain passage 31 and the first oil supply passage 21.

The advancing chamber 11 is communicated with annular oil pressure chambers 70, 71 formed in one of the vanes 10. Within the annular oil pressure chambers 70, 71, there is provided the hydraulic piston type lock pin (stopper pin that corresponds to a phase restraining means of the present invention) 6, which axially moves within a valve main body (guide ring) 72. When the lock pin 6 is urged by spring force of a spring 73 to axially move and thus is engaged with an engaging hole (engaging portion) 19a formed in a rear end wall (formed at a position that corresponds to the intermediate locking phase of the vane rotor 3) of the front cover portion 19 of the shoe housing 15, the lock pin 6 locks the camshaft 2, the vane rotor 3 and the vanes 10 at the intermediate locking phase.

The oil pressure developed in the retarding chamber 12 is always applied to a head portion of the lock pin 6. Furthermore, the advancing oil pressure introduced in the oil pressure chambers 70, 71 is applied to a flange 74 formed along an outer peripheral surface of the lock pin 6. The oil pressure chambers 70, 71 and the spring 73 constitute a lock pin drive mechanism, which drives the lock pin 6 to protrude and retract from a front end surface of the valve main body 72. An oil passage 75 for communicating between the oil pressure chamber 70 and the advancing chambers 11 is formed in the vane 10 and the chain sprocket 14 of the present embodiment. Furthermore, there is also provided an oil passage 76, which communicates between the oil pressure chamber 71 and the advancing chamber 11 when the vane rotor 3 and the vanes 10 are advanced beyond the intermediate locking phase. Furthermore, a retarding oil pressure is applied to the head portion of the lock pin 6 through an oil passage 78, which is connected to the retarding chamber 12.

The advance assist spring 7 is received in the annular spring receiving groove 17 formed in the front end wall surface of the chain sprocket 14, as described above. The advance assist spring 7 is provided to advance the phase of the camshaft 2, the vane rotor 3 and the vanes 10 relative to the timing rotor 1 beyond the intermediate locking phase even when the oil pressure drops, for example, upon engine stop. The advance assist spring 7 corresponds to an advance side urging means of the present invention and is the torsion coil spring, which receives a torsional moment about a coil central axis.

One end of the advance assist spring 7 is held in a securing groove 37 formed in the front end wall surface of the chain sprocket 14, and the other end of the advance assist spring 7 acts as the movable end. The other end of the advance assist spring 7 is hooked to the pin 35, which is press fitted and is secured to the vane rotor 3. The pin 35 protrudes through the window 36 of the seal plate 34 and engages the other end of the advance assist spring 7. The window 36 of the seal plate 34 is the generally arcuate shaped relief hole, which allows movement of the vane rotor 3 and the vanes 10 from the maximum retarded phase to the maximum advanced phase without interfering with the pin 35.

Furthermore, an advance side engaging wall 38 and a retard side engaging wall 39 are formed in an outer peripheral wall of the spring receiving groove 17. The other end of the advance assist spring 7 engages the advance side engaging wall 38 when the vane rotor 3 and the vanes 10 are advanced. On the other hand, the other end of the advance assist spring 7 engages the retard side engaging wall 39 when the vane rotor 3 and the vanes 10 are retarded. A circumferential space between the advance side engaging wall 38 and the retard side engaging wall 39 determines an effective range of urging force of the advance assist spring 7. The effective range of the urging force of the advance assist spring 7 is between the maximum retarded phase of the vane rotor 3 and thus of the vanes 10 and a predetermined phase of the vane rotor 3 and thus of the vanes 10, which is located beyond the intermediate locking phase on the advance side. More specifically, the predetermined phase of the vane rotor 3 and thus of the vanes 10 is equal to the intermediate locking phase+10 degree CA. Thus, the effective range of the urging force of the advance assist spring 7 is held between the maximum retarded phase and the predetermined phase, i.e., (the intermediate locking phase+10 degree CA) that is greater than the intermediate locking phase.

A generally arcuate relief groove 40 is formed in the outer peripheral wall of the spring receiving groove 17 of the chain sprocket 14. The relief groove 40 allows advance movement of the vane rotor 3 and the vanes 10 beyond the effective range of the urging force of the advance assist spring 7 without interference with the pin 35.

(Characteristics of the First Embodiment)

Operation of the continuously variable valve timing adjusting system of the present embodiment will be briefly described with reference to FIGS. 1 to 6. FIG. 5 shows the advance control mode of the continuously variable intake valve timing mechanism. FIG. 6 shows the drain mode of the continuously variable intake valve timing mechanism.

When the engine is operated at an idling engine speed before the engine is turned off, the camshaft 2, the vane rotor 3 and the vanes 10 are under the retard control of the ECU, so that the camshaft 2, the vane rotor 3 and the vanes 10 are positioned near the maximum retarded phase. When the engine is turned off, that is, when the ECU determines that an ignition switch is turned off, the ECU starts the advance control mode.

More specifically, the ECU supplies the drive current to the electromagnetic actuators 4*b*, 5*b* to shift both the electromagnetic oil passage switch valve 4 and the electromagnetic oil pressure control valve 5 to the advance control mode. Thus, the spool 4*a* of the electromagnetic oil passage switch valve 4 is axially moved to discommunicate between the third oil supply passage 23 and the third oil drain passage 33. Furthermore, the spool 46 of the electromagnetic oil pressure control valve 5 is axially moved, so that the center oil passage in the outer peripheral portion of the spool 46 communicates between the oil supply passage 29 and the first oil supply passage 21, and the right oil passage in the outer peripheral portion of the spool 46 communicates between the second oil drain passage 32 and the second oil supply passage 22.

Thus, the oil is supplied to each advancing chamber 11, and the oil is drained from each retarding chamber 12. However, after the engine is turned off, the amount of the oil pumped out from the pump 20 is very small, so that an oil pressure in each advancing chamber 11 and the first oil supply passage 21 is reduced, and thus the vane rotor 3 is not easily moved toward the advance side by the oil pressure alone. However, in the present embodiment, the spring force of the advance assist spring 7 received in the spring receiving groove 17 of the chain sprocket 14 and the oil pressure in each advancing chamber 11 cooperate together to push the vane rotor 3 and the vanes 10 toward the advance side. Thus, the phase of the vane rotor 3 and thus of the vanes 10 is advanced from the maximum retarded phase toward the maximum advanced phase.

Here, the effective range of the urging force of the advance assist spring 7 is determined by the advance side engaging wall 38 and the retard side engaging wall 39 formed radially outward of the spring receiving groove 17 of the chain sprocket 14. That is, the effective range of the urging force of the advance assist spring 7 is set between the maximum retarded phase and the predetermined phase, i.e., (the intermediate locking phase+10 degree CA). Thus, when the vane rotor 3 and the vanes 10 are advanced beyond the predetermined phase, i.e., (the intermediate locking phase+10 degree CA), the vane rotor 3 is advanced only by the oil pressure in each advancing chamber 11.

Furthermore, after the vane rotor 3 and the vanes 10 are advanced beyond the predetermined phase, i.e., (the intermediate locking phase+10 degree CA), the oil pressure is supplied to the oil pressure chamber 71 located on the rear side of the flange 74 of the lock pin 6 through the oil passages 76, 77, so that the oil pressure in the oil chamber 70 located on the front side of the flange 74 becomes equal to the oil pressure in the oil chamber 71 located on the rear side of the flange 74. As a result, as shown in FIG. 5, the lock pin 6 is pushed by the spring force of the spring 73 and thus protrudes from the front end surface of the vane 10 to engage with the front cover portion 19 of the shoe housing 15.

Thereafter, when the ECU detects that the phase of the vane rotor 3 and thus of the vanes 10 exceeds the predetermined phase, i.e., (the intermediate locking phase+10 degree CA) based on the signal from the crank angle sensor and the signal from the cam angle sensor, the ECU stops (i.e., turns off) the supply of the drive current to both the electromagnetic actuator 4*b* of the electromagnetic oil passage switch valve 4 and the electromagnetic actuator 5*b* of the electromagnetic oil pressure control valve 5, so that the advance control of the ECU ends.

When the engine is started once again next time, that is, when the ECU determines that the ignition switch has been turned on, the ECU starts the drain mode. More specifically, the ECU supplies the drive current to the electromagnetic actuators 4*b*, 5*b* to shift both the electromagnetic oil passage switch valve 4 and the electromagnetic oil pressure control valve 5 to the drain mode. Thus, the spool valve 4*a* of the electromagnetic oil passage switch valve 4 is axially moved to communicate between the third oil supply passage 23 and the third oil drain passage 33. Furthermore, the spool 46 of the electromagnetic oil pressure control valve 5 is axially moved, so that the center oil passage in the outer peripheral portion of the spool 46 communicates between the oil supply passage 29 and the first oil supply passage 21, and the right oil passage in the outer peripheral portion of the spool 46 communicates between the second oil drain passage 32 and the second oil supply passage 22. Thus, the oil is drained from each advancing chamber 11 and also from each retarding chamber 12.

The vane rotor 3 and the vanes 10, which are stopped beyond the predetermined phase, i.e., (the intermediate locking phase+10 degree CA) on the advance side after the engine is turned off, starts moving toward the retard side due to an increase in a drive torque of the camshaft 2 right after the ignition switch is turned on. Then, when the vane rotor 3 and the vanes 10 are retarded to the predetermined phase, i.e., (the intermediate locking phase+10 degree CA), the spring force of the advance assist spring 7 is exerted on the vane rotor 3 and the vanes 10. However, since the vane rotor 3 and the vanes 10 are stopped at the phase near the intermediate locking phase, the vane rotor 3 and the vanes 10 get much less reaction force from the advance assist spring 7 in comparison to the reaction force applied to the vane rotor 3 and the vanes 10 when they are at the maximum retarded phase. Thus, the vane rotor 3 and the vanes 10 located at the predetermined phase, i.e. (the intermediate locking phase+10 degree CA) are forced toward the retard side due to the increase in the drive torque of the camshaft 2 and are then forced once again toward the advance side due to the spring force of the advance assist spring 7, causing fluctuation of the phase of the vane rotor 3 and thus of the vanes 10. However, the vane rotor 3 and the vanes 10 are located at the phase near the intermediate locking phase on the advance side thereof, so that when the drive torque of the camshaft 2 is increased beyond the spring force of the advance assist spring 7, the phase of the vane rotor 3 and thus of the vanes 10 is retarded to the intermediate locking phase.

Then, when the phase of the vane rotor 3 and thus of the vanes 10 is retarded to the intermediate locking phase, the head portion of the lock pin 6, which has moved together with the vane rotor 3 and the vanes 10, is engaged with the engaging hole 19*a* formed in the rear end wall of the front cover portion 19 of the shoe housing 15, as shown in FIG. 6. Thus, the phase of the vane rotor 3 and thus of the vanes 10 is locked (or secured) at the intermediate locking phase. As a result, the relative rotation of the camshaft 2, the vane rotor 3 and the vanes 10 relative to the shoe housing 15 of the timing rotor 1 is restrained, so that the engine can be started while the camshaft 2, the vane rotor 3 and the vanes 10 are placed at the intermediate locking phase.

Since the engine can be started next time while the camshaft 2, the vane rotor 3 and the vanes 10 are placed at the intermediate locking phase, each intake valve is placed under the optimum valve timing suitable for cold start of the engine. This allows reduction of engine emissions, reduction of engine start failure, and reduction of the time required for starting the engine. Furthermore, the valve timing is optimized for reducing the fuel consumption of the engine after warming up of the engine, so that the engine power can be increased, and the engine emissions can be reduced.

Load torque, which is applied to the camshaft 2 when the camshaft 2 drives the intake valves, fluctuates in negative and positive directions. The positive direction of the load torque is the retard direction of the vane rotor 3 relative to the shoe housing 15, and the negative direction of the load torque is the advance direction of the vane rotor 3 relative to the shoe housing 15. An average load torque is generally applied in the positive direction, i.e., the retard direction. The urging force (spring force) of the advance assist spring 7 can be set to be equal to or greater than the average drive torque of the camshaft 2.

In such a case, when the vane rotor 3 and the vanes 10 are stopped at a phase near the maximum retarded phase at the time of engine stall, the vane rotor 3 and the vanes 10 can be advanced to the predetermined phase, i.e., (the intermediate locking phase+10 degree CA) only by the spring force of the advance assist spring 7 without the aid of the oil pressure. At this time, it is possible that the head portion of the lock pin 6 engages the engaging hole 19*a* formed in the rear end wall of the front cover portion 19 of the shoe housing 15 when the vane rotor 3 and the vanes 10 are advanced to the intermediate locking position. In this manner, the relative rotation of the camshaft 2, the vane rotor 3 and the vanes 10 relative to the shoe housing 15 of the timing rotor 1 is restrained. Thus, even after the engine stall, the engine can be started while the camshaft 2, the vane rotor 3 and the vanes 10 are placed at the intermediate locking phase.

The torque generated from the continuously variable intake valve timing mechanism, particularly, the torque generated from the vane rotor 3 can be selected to satisfy the following relationship: (an average drive torque of the camshaft 2+a torque generated from the continuously variable intake valve timing mechanism at the time of the minimum oil pressure)>the spring force of the advance assist spring 7. In this way, when it is desired to stop the vane rotor 3 and the vane 10 at the phase near the maximum retarded phase at the time of the minimum oil pressure, the spring force of the advance assist spring 7 does not cause advancement of the vane rotor 3 and the vanes 10 from the phase near the maximum retarded phase. As a result, the fuel consumption can be reduced during the low engine loads.

(Second Embodiment)

Figure 7:
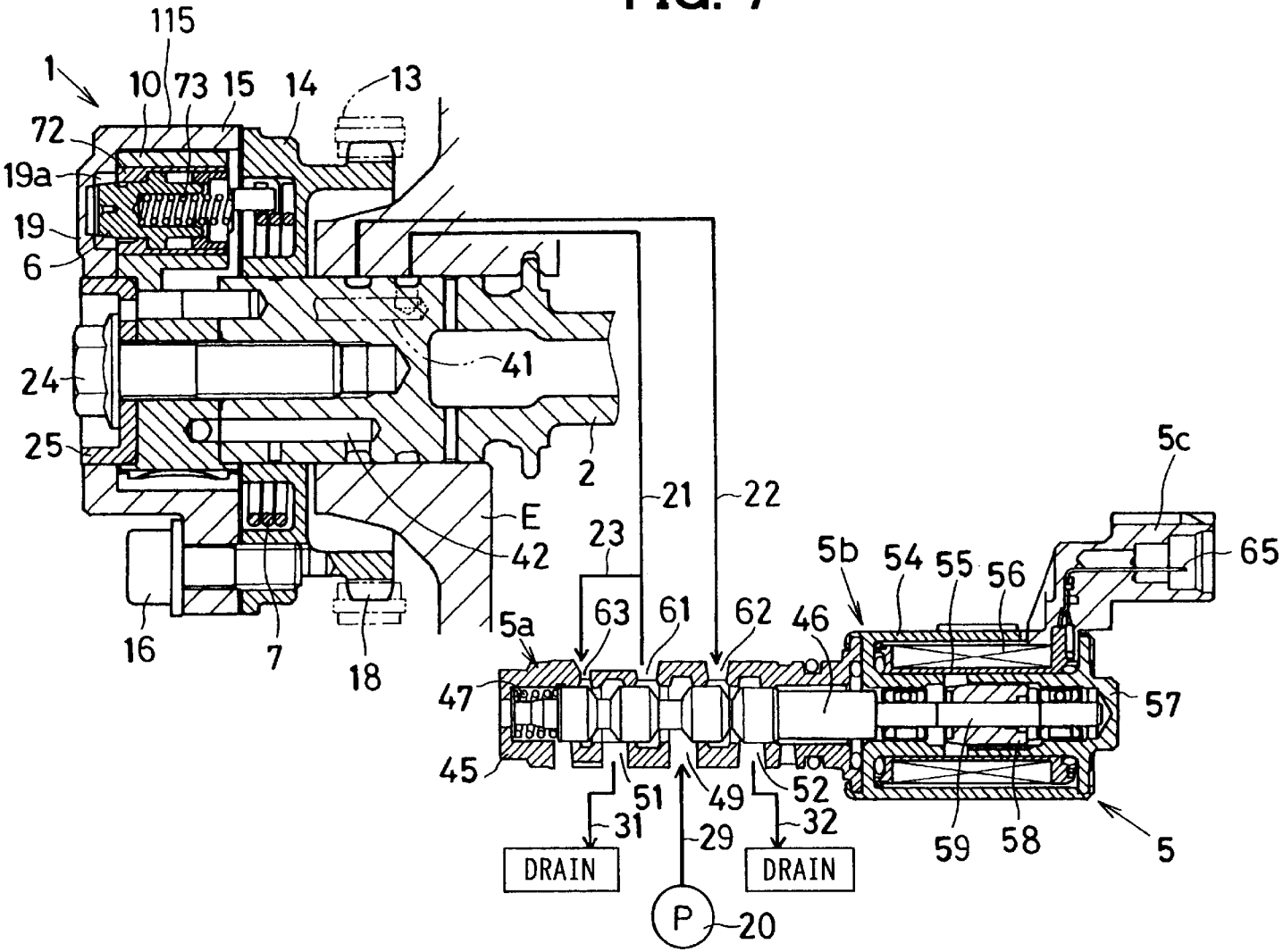
FIG. 7 is a schematic view showing a main feature of a continuously variable intake valve timing mechanism according to a second embodiment of the present invention.

FIG. 7 shows a second embodiment of the present invention and indicates a main feature of the continuously variable intake valve timing mechanism according to the embodiment.

In the present embodiment, the control mode of the electromagnetic oil pressure control valve 5 can be changed to any one of the retard control mode, the advance control mode and the drain mode. The electromagnetic oil pressure control valve 5 corresponds to the hydraulic pressure supply/drain means of the present invention. The electromagnetic oil pressure control valve 5 includes the control valve 5*a,* which is arranged in the hydraulic system circuit, and the electromagnetic actuator 5*b,* which drives the control valve 5*a.* The control valve 5*a* includes a sleeve 45, a spool 46 and a spring 47. The sleeve 45 is arranged between the first to third oil supply passages 21–23 and the oil supply passage 29 and the first and second oil drain passages 31, 32. The spool 46 is slidably received in the sleeve 45. The spring 47 urges the spool 46 to its initial position.

The sleeve 45 has the oil supply port 49, the first and second drain ports 51, 52, and the first to third oil supply/drain ports 61–63. The first drain port 51 of the present embodiment also acts as an oil passage for draining the oil from the advancing chambers 11 and the oil pump 20 during the drain mode. The first drain port 51 is communicated with the first oil supply/drain port 61 through the third oil supply passage 23 and the first oil supply passage 21. The third oil supply/drain port 63 also acts as an oil passage for draining the oil from the advancing chambers 11 and the oil pump 20 during the drain mode. The third oil supply/drain port 63 is communicated with the oil pan 30 through the first oil drain passage 31. Four lands, i.e., the first to fourth lands are formed in the outer peripheral portion of the spool 46 to define three oil passages, which are axially arranged between a left end and a right end of the spool 46 in FIG. 7.

As described above, in the continuously variable intake valve timing mechanism of the present embodiment, the control mode can be changed to one of the retard control mode, the advance control mode and the drain mode by the electromagnetic oil pressure control valve 5 alone. Thus, the electromagnetic oil passage switch valve 4 of the first embodiment can be eliminated. In this way, the number of the components can be reduced, and thus the product cost can be reduced.

(Third Embodiment)

Figure 8:
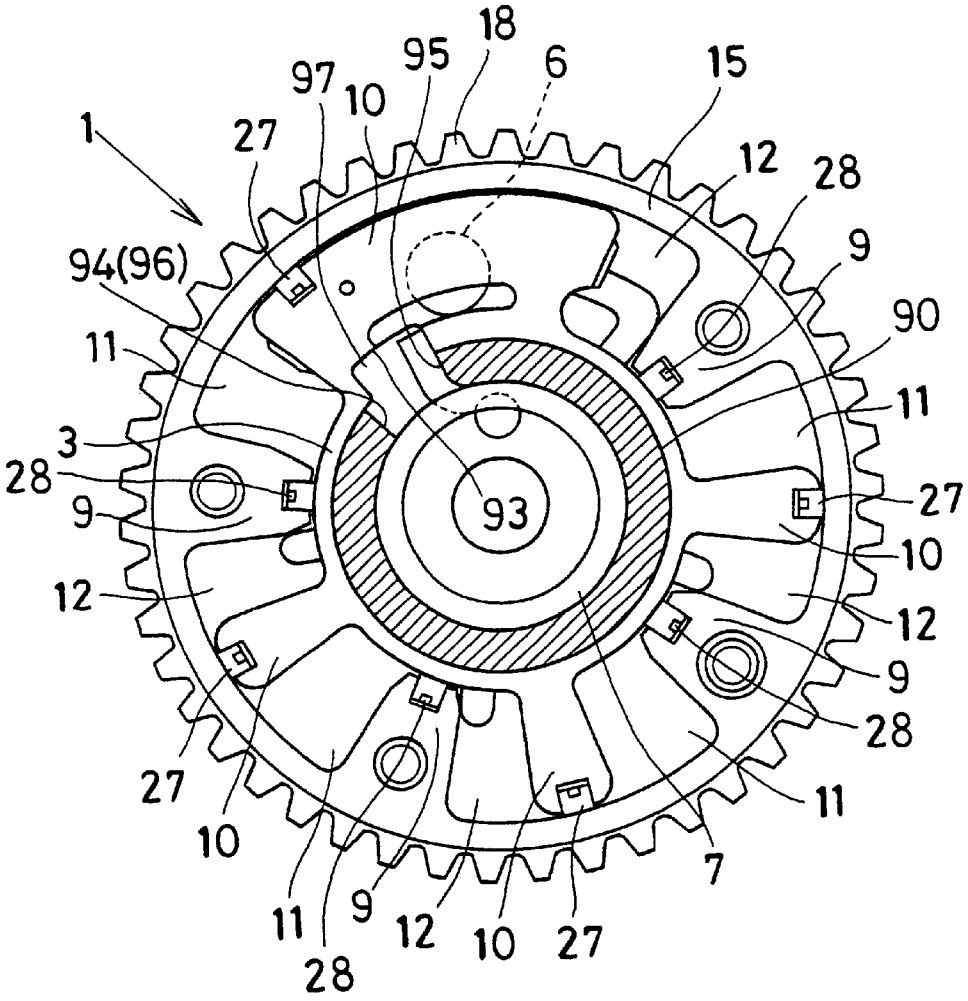
FIG. 8 is a front view showing a main feature of a continuously variable intake valve timing mechanism according to a third embodiment.
Figure 9:
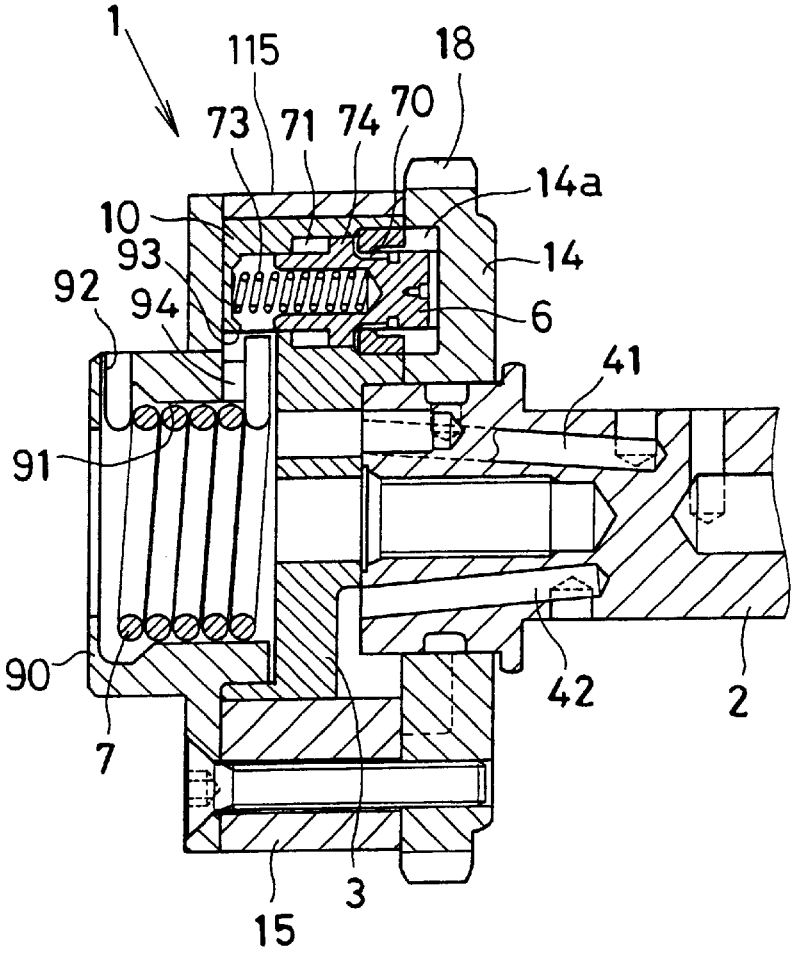
FIG. 9 is a cross-sectional view showing the main feature of the continuously variable intake valve timing mechanism according to the third embodiment.
Figure 11A:
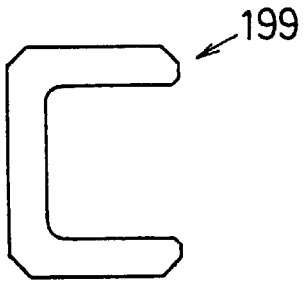
FIG. 11A is a side view of a wear resistant member according to the fourth embodiment.
Figure 11B:
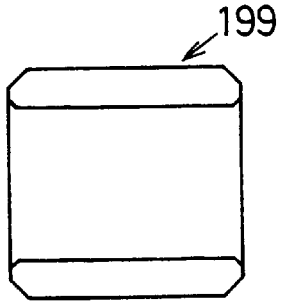
FIG. 11B is a front view of the wear resistant member according to the fourth embodiment.

FIGS. 8 and 9 show a third embodiment of the present invention and indicates a main feature of the continuously variable intake valve timing mechanism according to the embodiment.

The shoe housing 15, which constitutes the timing rotor 1 of the present embodiment, has an annular front cover (front cover portion) 90, which covers the axial front end of the shoe housing main body 115 and is separated from the shoe housing main body 115. An annular spring guide 91 is formed in an inner peripheral portion of the front cover 90. The annular spring guide 91 forms a spring receiving groove for receiving the advance assist spring 7, which is the torsion coil spring.

The advance assist spring 7 corresponds to the advance side urging means of the present invention. Similar to the first embodiment, the advance assist spring 7 is the torsion coil spring. One end of the advance assist spring 7 is held in a securing groove (engaging portion) 92 formed in a front end wall of the front cover 90, and the other end of the advance assist spring 7 acts as the movable end. The other end of the advance assist spring 7 is received in an arcuate engaging groove or engaging portion (engaging recess) 93 formed in an inner peripheral surface of the vane 10 of the vane rotor 3. The other end of the advance assist spring 7 extends through a window 94 formed in a rear end portion of the front cover 90 and engages the engaging groove 93. The window 94 is the generally arcuate relief hole that allows movement of the vane rotor 3 and the vanes 10 between the maximum retarded phase to the maximum advanced phase without interfering with the other end of the advance assist spring 7.

The window 94 acts as the wall that determines a spring operative range, which in turn, determines the effective range of the urging force of the advance assist spring 7. That is, the window 94 includes an advance side engaging wall 95 and a retard side engaging wall 96. The other end of the advance assist spring 7 engages the advance side engaging wall 95 when the vane rotor 3 and the vanes 10 are advanced. Furthermore, the other end of the advance assist spring 7 engages the retard side engaging wall 96 when the vane rotor 3 and the vanes 10 are retarded. A circumferential space between the advance side engaging wall 95 and the retard side engaging wall 96 determines the effective range of the urging force of the advance assist spring 7. The effective range of the urging force of the advance assist spring 7 is between the maximum retarded phase of the vane rotor 3 and thus of the vanes 10 and a predetermined phase of the vane rotor 3 and thus of the vanes 10, which is located beyond the intermediate locking phase on the advance side thereof. More specifically, the predetermined phase of the vane rotor 3 and thus of the vanes 10 is equal to the intermediate locking phase+10 degree CA. Thus, the effective range of the urging force of the advance assist spring 7 is held between the maximum retarded phase and the predetermined phase, i.e., (the intermediate locking phase+10 degree CA) that is greater than the intermediate locking phase.

The engaging groove 93 of the vane rotor 3 has a spring relief groove 97. The spring relief groove 97 has a phase range that allows advancement of the vane rotor 3 and the vanes 10 beyond the effective range of the urging force (spring operating range) of the advance assist spring 7. Here, the lock pin 6 of the present embodiment engages the engaging hole (engaging portion) 14*a* formed in the front end wall of the chain sprocket 14 when the camshaft 2, the vane rotor 3 and the vanes 10 reach the intermediate locking phase.

(Fourth Embodiment)

Figure 10A:
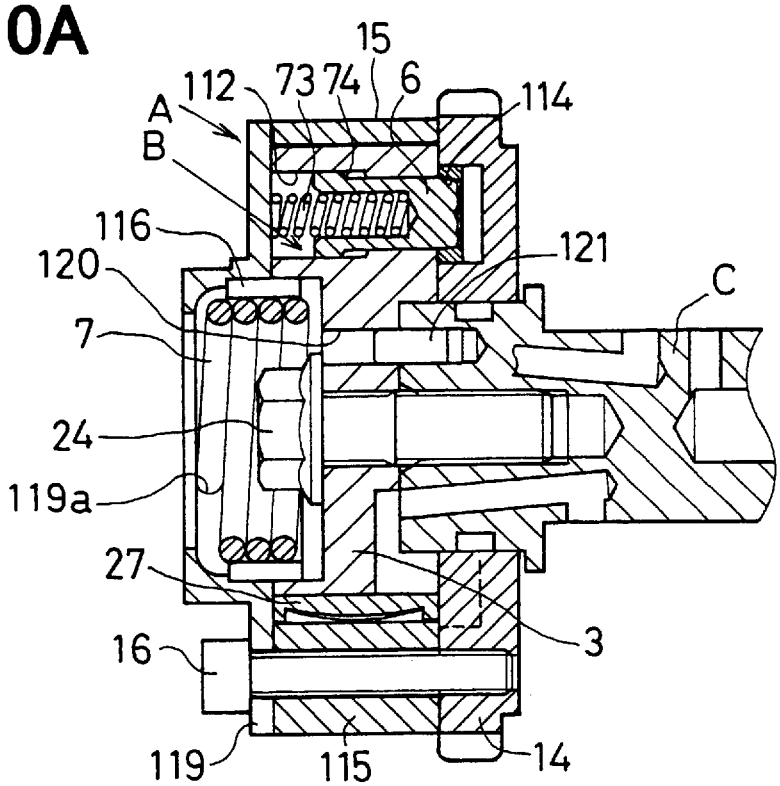
FIG. 10A is a longitudinal partial cross-sectional view of a valve timing adjusting system according to a fourth embodiment of the present invention.
Figure 10B:
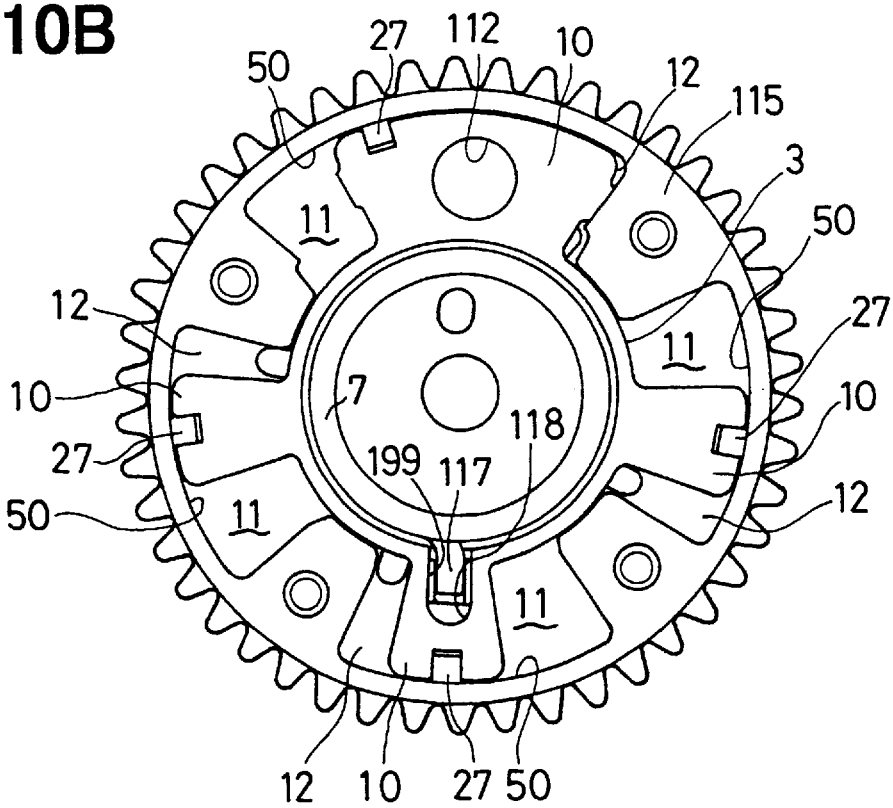
FIG. 10B is a view showing an interior of a shoe housing of the valve timing adjusting system according to the fourth embodiment.

A fourth embodiment will be described with reference to FIGS. 10A to 11B. FIG. 10A is a longitudinal partial cross-sectional view of a valve timing adjusting system. FIG. 10B is a view showing a n interior of a shoe housing. In a DOHC engine, which includes intake valves and exhaust valves independently driven by separate camshafts, the valve timing adjusting system of the present embodiment is provided to an exhaust camshaft. The valve timing adjusting system changes valve timing of the exhaust valves in a continuous manner or in a stepwise manner. In this embodiment, the left side of FIG. 10A is referred to as a front side, and the right side of FIG. 10A is referred to as a rear side.

The valve timing adjusting system includes a driving member A, which is driven by a crankshaft through a timing chain (or a timing belt or the like) and a driven member B, which is driven by the driving member A and transmits drive torque of the driving member A to a camshaft C. The driven member B is rotated relative to the driving member A by an arrangement, which will be described in greater details below, so that the camshaft C is rotated toward an advance side or a retard side.

The driving member A includes a shoe housing 15 and a sprocket wheel 14 and is driven synchronously with the crankshaft The shoe housing 15 includes a front plate 119 and a shoe housing main body 115. The front plate 119, the shoe housing main body 115 and the sprocket wheel 14 are secured together with a plurality of bolts 16. The driving member A is rotated by the timing chain in a clockwise direction in FIG. 10B, which is referred to as an advance direction. A plurality (four in this embodiment) of fan shaped spaces or fan shaped recesses 50 are formed in the shoe housing main body 115, as shown in FIG. 10B.

The driven member B includes a vane rotor 3, which is secured to the camshaft C with a bolt 24. The vane rotor 3 includes a plurality of vanes 10 and can be rotated relative to the shoe housing 15 within a predetermined angular range. Each vane 10 divides the corresponding space 50 of the shoe housing main body 115 into an advancing chamber 11 and a retarding chamber 12. Each one of the advancing chamber 11 and the retarding chamber 12 is an oil pressure chamber, which is surrounded by the front plate 119, the shoe housing main body 115, the sprocket wheel 14 and the vane rotor 3. The advancing chamber 11 and the retarding chamber 12 are sealed relative to one another by a seal member 27 arranged in a distal end groove of the corresponding vane 10.

The advancing chamber 11 moves the corresponding vane 10 toward the advance side by oil pressure and is provided in the space 50 on a counterclockwise side of the corresponding vane 10 in FIG. 10B. The retarding chamber 12 moves the corresponding vane 10 toward the retard side by oil pressure and is provided on the clockwise side of the corresponding vane 10 in FIG. 10B.

The valve timing adjusting system includes an oil pressure difference generating means (not shown), which generates an oil pressure difference between each advancing chamber 11 and the corresponding retarding chamber 12 by supplying or draining a fluid (oil) relative to the advancing chamber 11 and the retarding chamber 12. The oil pressure difference generating means rotates the vane rotor 3 relative to the shoe housing main body 115 by generating the oil pressure difference between each advancing chamber 11 and the corresponding retarding chamber 12.

By way of example, the oil pressure difference generating means in this particular embodiment includes an oil pump, one or more switch valves, an electromagnetic actuator and a controller. The oil pump is drive by the crank shaft. The one or more switch valves switch supply of the oil, which is pumped by the oil pump, between each advancing chamber 11 and the corresponding retarding chamber 12. The electromagnetic actuator drives the one or more switch valves. The controller controls the electromagnetic actuator. The controller controls the electromagnetic actuator based on an operating state of the engine determined based on a crank angle, an engine speed, an accelerator pedal position and the like, which are measured through corresponding sensors. Thus, appropriate oil pressure, which corresponds to the operating state of the engine, is applied to each one of the advancing chamber 11 and the retarding chamber 12.

A lock pin 6 is provided in one of the vanes 10. The lock pin 6 locks a rotational position of the vane rotor 3 at a predetermined advanced phase (e.g., the maximum advanced phase) at the time of engine start. The lock pin 6 is received in a receiving hole 112, which penetrates through the vane 10. The lock pin 6 is urged toward the rear side by a compression spring 73. The vane rotor 3 is locked relative to the shoe housing main body 115 when a head (rear end portion) of the lock pin 6 is engaged with a engaging hole 114 formed in the sprocket wheel 14.

A flange 74 is formed in the lock pin 6. The flange 74 receives the hydraulic pressure to move the lock pin 6 toward the front side (in the direction for releasing the engagement of the lock pin 6). The flange 74 is communicated with the corresponding advancing chamber 11. When the oil, which is pressurized to a level equal to or greater than a predetermined pressure, is supplied to the corresponding advancing chamber 11, the lock pin 6 is urged to overcome the urging force of the compression spring 73 by the pressurized oil and is released from the engaging hole 114. A rear end surface of the lock pin 6 is communicated with the corresponding retarding chamber 12. When the oil, which is pressurized to a level equal to or greater than a predetermined pressure, is supplied to the corresponding retarding chamber 12, the lock pin 6 is urged to overcome the urging force of the compression spring 73 by the pressurized oil and is released from the engaging hole 114.

The valve timing adjusting system includes a torsion coil spring (hereinafter referred to as "assist spring") 7. The assist spring 7 urges the driven member B relative to the driving member A toward the advance side. One end of the assist spring 7 is engaged with the shoe housing 15 or a component that rotates together with the shoe housing 15. The other end of the assist spring 7 is engaged with the vane rotor 3. In this embodiment, the one end of the assist spring 7 is inserted in and engaged with a receiving hole (engaging portion) 119*a* formed in the front plate 119.

A cylindrical coil cover 116 is arranged around a coiled portion of the assist spring 7. The coil cover 116 prevents the coiled portion of the assist spring 7 from interfering with the front plate 119 and the vane rotor 3. The coil cover 116 is made of a relatively rigid material (e.g., iron, stainless steel or the like) and prevents wearing of the front plate 119 and the vane rotor 3 made of a relatively soft material (e.g., aluminum, soft iron or the like) through engagement with the relatively rigid assist spring 7.

Engagement between the end portion (the other end) 117 of the assist spring 7, which is located on the vane rotor 3 side of the assist spring 7, and the vane rotor 3 will be described. The end portion 117 extends in a direction perpendicular to an axial direction, as shown in FIG. 10B. In this embodiment, the end portion 117 extends outwardly in a radial direction of the assist spring 7.

The vane rotor 3 includes a hook groove (engaging portion) 118, to which the end portion 117 of the assist spring 7 is engaged. The hook groove 118 also extends in the direction perpendicular to the axial direction.

As described above, the vane rotor 3 is made of the relatively soft material, such as the aluminum, the soft iron or the like. Because of this, a wear resistant member 199 is installed within the hook groove 118. The wear resistant member 199 prevents wearing of the vane rotor 3 through engagement with the end portion 117 of the relatively rigid assist spring 7. The wear resistant member 199 is made of a wear resistant material (e.g., stainless steel, ordinary iron or the like). The wear resistant member 199 of the present embodiment has a shape shown in FIGS. 11A and 11B. The wear resistant member 199 has a generally horseshoe shaped cross section, which covers three sides of the end portion 117 of the relatively rigid assist spring 7 when it is received in the hook groove 118.

In this embodiment, the wear resistant member 199 has the generally horseshoe shaped cross section. However, the wear resistant member 199 can have any other shape, such as a rectangular tube shape or a cylindrical tube shape, as long as it can prevent the interfering between the end portion 117 of the assist spring 7 and the vane rotor 7 within the hook groove 118.

As described above, in the valve timing adjusting system of the fourth embodiment, the end portion 117 of the assist spring 7 extends in the direction perpendicular to the axial direction. Thus, an axial length of the assist spring 7 is reduced in comparison to the one, which has the end portion of the assist spring extending in the axial direction.

Furthermore, the hook groove 118, which engages with the assist spring 7, extends in the direction perpendicular to the axial direction of the vane rotor 3, so that it is not necessary to provide a hole that extends in the axial direction for engaging with the assist spring 7. As a result, it is possible to reduce a thickness of the vane rotor 3 in the axial direction of the vane rotor 3.

As described above, the axial size of the assist spring 7 is reduced, and the axial thickness of the vane rotor 3 is reduced, so that an axial size of the valve timing adjusting system is reduced.

Furthermore, in the present embodiment, the vane rotor 3 is made of the relatively soft material, such as the aluminum, the soft iron and the like. However, the wear resistant member 199 is received in the hook groove 118, so that the wear resistant member 199 resides between the end portion 117 of the assist spring 7 and hook groove 118. As a result, wearing of the vane rotor 3 through engagement with the end portion 117 of the assist spring 7 is prevented.

In this way, manufacturing of the vane rotor 3 with the relatively soft material, such as the aluminum or the soft iron, is allowed. Thus, manufacturability of the vane rotor 3 is improved. As a result, a manufacturing cost of the vane rotor 3, and thus of the valve timing adjusting system, can be reduced.

(Fifth Embodiment)

Figure 12A:
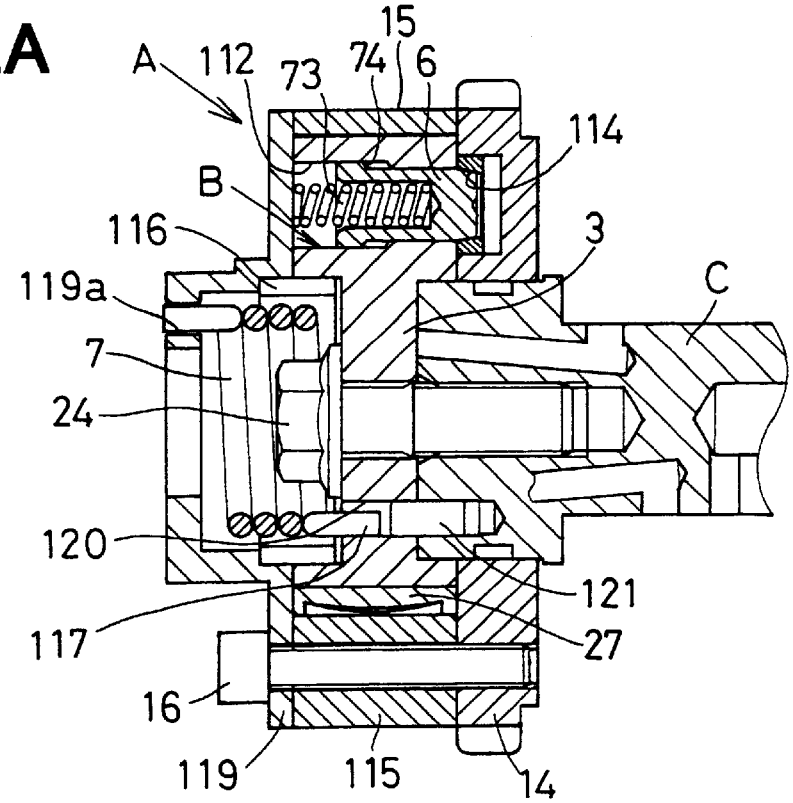
FIG. 12A is a longitudinal cross-sectional view of a valve timing adjusting system according to a fifth embodiment of the present invention.
Figure 12B:
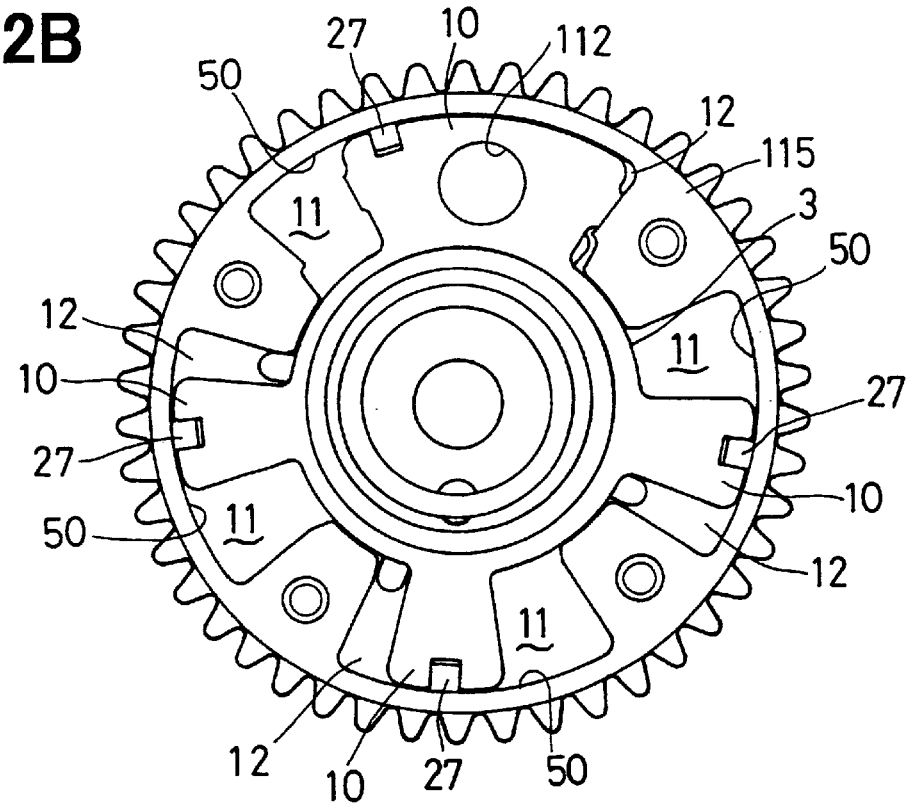
FIG. 12B is a view showing an interior of a shoe housing according to the fifth embodiment.

A fifth embodiment of the present invention will be described with reference to FIGS. 12A and 12B. FIG. 12A is a longitudinal partial cross-sectional view of the valve timing adjusting system. FIG. 12B is a front view of the valve timing adjusting system after removal of the front plate 119.

Although it is not described in the fourth embodiment, the vane rotor 3 has a positioning hole 120 for positioning the vane rotor 3 relative to the camshaft C. The positioning hole 120 extends through the vane rotor 3 in the axial direction thereof. The vane rotor 3 is appropriately positioned relative to the camshaft C by inserting a positioning pin 121, which is press fitted and is secured in a hole formed in an end surface of the camshaft C, into the positioning hole 120.

In the fifth embodiment, the end portion 117 of the assist spring 7, which engages with the vane rotor 3, extends in the axial direction. By engaging this end portion 117 of the assist spring 7 to the positioning hole 120, the assist spring 7 is engaged with the vane rotor 3.

Furthermore, in the fifth embodiment, the vane rotor 3 is different from the vane rotor of the fourth embodiment. That is, the vane rotor 3 of the fifth embodiment is made of the relatively rigid material (e.g., the ordinary iron). Thus, even though the end portion 117 of the assist spring 7 is directly inserted in the positioning hole 120 formed in the vane rotor 3, contact of the end portion 117 of the assist spring 7 with the vane rotor 3 does not cause substantial wearing of the vane rotor 3.

In the valve timing adjusting system of the fifth embodiment, the end portion 117 of the assist spring 7, which engages with the vane rotor 3, extends in the axial direction, and the end portion 117 of the assist spring 7 is inserted in the positioning hole 120 of the vane rotor 3 to engage the assist spring 7 with the vane rotor 3. Thus, it is not necessary to provide a dedicated hole for engaging with the assist spring 7 in the vane rotor 3. As a result, it is possible to reduce a manufacturing cost of the vane rotor 3, and thus of the valve timing adjusting system.

(Modifications)

In the first to third embodiments, the three shoes 9 are provided at the inner peripheral portion of the shoe housing 15, and the three vanes 10 are arranged at the outer peripheral portion of the vane rotor 3. Thus, the three advancing chambers (advancing oil pressure chambers) 11 and the three retarding chambers (retarding oil pressure chambers) 12 are formed, and the continuously variable valve timing is achieved with this arrangement. This can be modified as follows. That is, four or more shoes 9 can be formed at the inner peripheral portion of the shoe housing 15, and four or more vanes 10 can be formed at the outer peripheral portion of the vane rotor 3 like the fourth and fifth embodiments. In this way, four or more advancing chambers (advancing oil pressure chambers) 11 and four or more retarding chambers (retarding oil pressure chambers) 12 are formed, and the continuously variable valve timing can be achieved with this arrangement. Alternatively, two advancing chambers (advancing oil chambers) 11 and two retarding chambers (retarding oil chambers) 12 can be formed, and the continuously variable valve timing can be achieved with this arrangement.

In the first to third embodiments, during the operation of the engine at the idling speeds, a valve overlap (time when both the intake valve and the exhaust valve in one cylinder are simultaneously opened) can be eliminated by delaying (i.e., retarding) both the opening time and the closing time of the corresponding intake valve to stabilize combustion in the corresponding cylinder. Furthermore, during the operation of the engine at middle speeds and high loads, the valve overlap can be increased by advancing both the opening time and the closing time of the corresponding intake valve, so that an amount of self EGR (residual gas in the corresponding combustion chamber) is increased to reduce the combustion temperature, and thus HC and NOx emissions are reduced. In this case, pumping losses in the engine are reduced, and thus the fuel consumption is reduced. Furthermore, during the operation of the engine at the high speeds and the high loads, the closing time of the corresponding intake valve can be delayed (i.e., retarded) to the optimum phase to achieve the maximum power of the engine.

Furthermore, an actual position of the camshaft 2 can be measured with a sensor, and the electromagnetic oil pressure control valve 5 can be controlled through feed back control based on the measured actual position of the camshaft 2 to achieve a target valve timing. Furthermore, in the above embodiments, the continuously variable valve timing is achieved. However, the valve timing can be varied in a stepwise manner among three modes, i.e., the advance control mode, the retard control mode and the drain mode or can be varied in a stepwise manner among more than three modes. Furthermore, besides the continuously variable intake valve timing mechanism, the present invention can be applied to a continuously variable intake and exhaust valve timing mechanism or to a continuously variable exhaust valve timing mechanism. Also, an overhead valve (OHV) engine or an overhead camshaft (OHC) engine can be used as the internal combustion engine of the present invention.

In the first embodiment, the other end of the advance assist spring 7 received in the spring receiving groove 17 formed in the front wall surface of the chain sprocket 14 of the timing rotor 1 acts as the movable end of the advance assist spring 7. The other end of the advance assist spring 7 is hooked to the pin (engaging projection) 35, which is press fitted and is secured to the rear end portion of the vane rotor 3 and the vane 10. Alternatively, the other end of the advance assist spring 7 is used as the movable end, and the other end of the advance assist spring 7 can be received in a securing hole or hook groove (engaging recess) formed in the rear end portion of the vane rotor 3 and the vane 10 like the fourth and fifth embodiments.

In the third embodiment, the other end of the advance assist spring 7 received in the spring guide 91 formed in the inner peripheral portion of the front cover 90 of the shoe housing 15 of the timing rotor 1 acts as the movable end, and the other end of the advance assist spring 7 is received in the engaging groove (engaging recess) 93 formed in the inner peripheral portion of the vane rotor 3 and the vane 10. Alternatively, the other end of the advance assist spring 7 is used as the movable end, and the other end of the advance assist spring 7 can be hooked to a pin (engaging projection), which is press fitted and is secured into a hole formed in t he inner peripheral portion of the vane rotor 3 and the vane 10.

In the above embodiments, the lock pin 6 moves in the axial direction of the vane rotor 3 and is engaged with the engaging hole 14*a,* 19*a,* 114. Alternatively, the lock pin 6 can be moved in a radial direction of the vane rotor 3 and can be engaged with the engaging hole 14*a,* 19*a,* 114. In this case, the engaging hole 14*a,* 19*a,* 114 should be formed in the inner peripheral wall of the shoe housing main body 115 of the shoe housing 15. Alternatively, the lock pin 6 may be received in the housing member that constitutes the timing rotor 1 or in the shoe housing 15, and the engaging hole can be formed in the vane rotor 3 and the vane 10.

In the above embodiments, the vane rotor 3 is secured to the end surface of the camshaft 2, C. The invention can be applied to the valve timing adjusting system that has the camshaft 2, C, which is received through the center of the vane rotor 3.

In the above embodiments, the shoe housing 15 is rotated together with the crankshaft (driving shaft), and the vane rotor 3 is rotated together with the camshaft 2, C (driven shaft). Alternatively, the vane rotor 3 can be rotated together with the crankshaft (driving shaft), and the shoe housing 15 can be rotated together with the camshaft 2, C (driven shaft).

In the above embodiments, the electromagnetic oil passage switch valve and the electromagnetic oil pressure control valve are used as the hydraulic pressure supply/drain means. Alternatively or in addition to these valves, a hydraulic oil passage switch valve can be used.

Additional advantages and modifications will readily occur to those skilled in the art. The invention in its broader terms is therefore, not limited to the specific details, representative apparatus, and illustrative examples shown and described.

What is claimed is:

1. A valve timing adjusting system of an internal combustion engine for adjusting opening time and closing time of at least one of intake and exhaust valves, wherein the valve timing adjusting system is provided in a driving force transmission system that allows the internal combustion engine to be started at generally an intermediate phase of a driven shaft located in the middle of a variable phase range of the driven shaft, which is driven by a driving shaft of the internal combustion engine to open and close the at least one of the intake and exhaust valves, the valve timing adjusting system comprising:

(a) a driving-side rotator, which is rotated synchronously with the driving shaft of the internal combustion engine;

(b) a driven-side rotator, which is rotated together with the driven shaft and is capable of relative rotation relative to the driving-side rotator;

(c) an advancing chamber, which applies hydraulic fluid pressure to the driven-side rotator to rotate the driven-side rotator in such a manner that a phase of the driven-side rotator is advanced relative to the driving-side rotator;

(d) a retarding chamber, which applies hydraulic fluid pressure to the driven-side rotator to rotate the driven-side rotator in such a manner that the phase of the driven-side rotator is retarded relative to the driving-side rotator;

(e) a hydraulic pressure supply/drain means, which supplies the hydraulic pressure to the advancing chamber and drains the hydraulic pressure from the retarding chamber when the internal combustion engine is turned off;

(f) a phase restraining means, which restrains the relative rotation between the driving-side rotator and the driven-side rotator at generally an intermediate phase of the driven-side rotator after the engine is turned off or when the engine is started, wherein the intermediate phase of the driven-side rotator is located in the middle of a variable phase range of the driven-side rotator; and (g) an advance side urging means, which applies urging force to the driven-side rotator to advance the driven-side rotator on an advance side, wherein an effective range of the urging force of the advance side urging means is between a maximum retarded phase of the driven-side rotator and a predetermined phase of the driven-side rotator, which is located near an intermediate phase of the driven-side rotator on an advance side of the intermediate phase of the driven-side rotator.

2. A valve timing adjusting system according to claim 1, wherein the predetermined phase, which is located near the intermediate phase of the driven-side rotator on the advance side of the intermediate phase of the driven-side rotator, is equal to the intermediate phase of the driven-side rotator+10 degree CA.

3. A valve timing adjusting system according to claim 1, wherein the urging force of the advance side urging means is equal to or greater than an average drive torque of the driven shaft.

4. A valve timing adjusting system according to claim 1, wherein the urging force of the advance side urging means is less than a sum of the average drive torque of the driven shaft and a torque generated from the driven-side rotator at time of minimum oil pressure applied to the driven-side rotator.

5. A valve timing adjusting system according to claim 1, wherein the driving-side rotator includes a sprocket and a shoe housing, wherein the sprocket is rotated synchronously with the driving shaft of the internal combustion engine, and the shoe housing is arranged at one end of the sprocket and is rotated together with the sprocket.

6. A valve timing adjusting system according to claim 5, wherein:

the advance side urging means is a spring, wherein one end of the spring is retained by the sprocket, and the other end of the spring is retained by the driven-side rotator;

the sprocket includes an advance side engaging wall and a retard side engaging wall, wherein the other end of the spring is engaged with the advance side engaging wall when the driven-side rotator is rotated to advance toward the advance side, and the other end of the spring is engaged with the retard side engaging wall when the driven-side rotator is rotated to retard toward the retard side; and the advance side engaging wall and the retard side engaging wall of the sprocket determines the effective range of the urging force of the spring.

7. A valve timing adjusting system according to claim 6, wherein:

the sprocket includes a spring receiving groove for receiving the spring and a securing groove for retaining the one end of the spring; and the driven-side rotator includes an engaging portion, which includes one of a protrusion and a recess, wherein the other end of the spring is engaged with the engaging portion of the driven-side rotator.

8. A valve timing adjusting system according to claim 5, wherein:

the shoe housing includes a shoe housing main body and a front cover portion, wherein the shoe housing main body relatively rotatably receives the driven-side rotator therein, and the front cover portion covers a front end side of the shoe housing main body;

the one end of the spring is retained by the front cover portion, and the other end of the spring is retained by the driven-side rotator through a window formed in the front cover portion; and the effective range of the urging force of the spring is determined by a size of the window of the front cover portion.

9. A valve timing adjusting system according to claim 8, wherein the other end of the spring is retained by an engaging portion of the driven-side rotator, which includes one of a protrusion and a recess.

10. A valve timing adjusting system according to claim 9, wherein the engaging portion of the driven-side rotator includes a spring relief portion located on an advance side of the effective range of the urging force of the spring.

11. A valve timing adjusting system according claim 8, wherein the front cover portion includes an engaging portion for retaining the one end of the spring, wherein the engaging portion of the front cover portion includes one of a protrusion and a recess.

12. A valve timing adjusting system according to claim 8, wherein the front cover portion includes a spring guide for receiving the spring at an inner peripheral portion of the front cover portion.

13. A valve timing adjusting system according to claim 1, wherein:

the hydraulic pressure supply/drain means is one of an electromagnetic oil pressure control valve, a hydraulic oil passage switch valve and an electromagnetic oil passage switch valve for selectively supplying and draining oil pressure generated in an oil pressure source to the advancing chamber and the retarding chamber; and the oil pressure source is an oil pump that is driven synchronously with the driving shaft of the internal combustion engine to pump out oil in an amount that is proportional to an engine speed of the internal combustion engine.

14. A valve timing adjusting system according to claim 1, wherein:

the advance side urging means is a spring, wherein one end of the spring is retained by the driving-side rotator, and the other end of the spring is retained by the driven-side rotator and extends in a direction perpendicular to an axial direction of the driven-side rotator; and the driven-side rotator includes an engaging portion for engaging with the other end of the spring, wherein the engaging portion of the driven-side rotator extends in the direction perpendicular to the axial direction of the driven-side rotator.

15. A valve timing adjusting system according to claim 14, wherein the engaging portion of the driven-side rotator receives a wear resistant member made of a wear resistant material, and the wear resistant member is arranged between the other end of the spring and the engaging portion of the driven-side rotator.

16. A valve timing adjusting system according to claim 1, wherein:

the advance side urging means is a spring, wherein one end of the spring is retained by the driving-side rotator, and the other end of the spring is retained by the driven-side rotator;

the driven-side rotator includes a positioning hole, which axially penetrates through the driven-side rotator for positioning the driven-side rotator to the driven shaft; and the other end of the spring retained by the driven-side rotator extends in an axial direction of the driven-side rotator and is engaged with the positioning hole.

* * * * *